US005284192A

United States Patent [19]

Sato et al.

[11] Patent Number: 5,284,192

[45] Date of Patent: Feb. 8, 1994

[54] AUTOMATIC PLANING MACHINE

[75] Inventors: Mitsumasa Sato; Tatsuya Wada; Kouichi Miyamoto, all of Tokyo, Japan

[73] Assignee: Ryobi Limited, Tokyo, Japan

[21] Appl. No.: 924,341

[22] Filed: Jul. 31, 1992

[30] Foreign Application Priority Data

Aug. 1, 1991 [JP] Japan ..... 3-060823[U]
Aug. 6, 1991 [JP] Japan ..... 3-196523
Sep. 17, 1991 [JP] Japan ..... 3-074369[U]

[51] Int. Cl.[5] ..... B27C 1/02

[52] U.S. Cl. ..... 144/117 R; 144/114 R; 144/246 R; 144/247; 144/249 R

[58] Field of Search ..... 144/114 R, 117 R, 128, 144/129, 130, 131, 246 R, 246 D, 247, 249 R; 198/624, 817, 838

[56] References Cited

U.S. PATENT DOCUMENTS 5,174,348 12/1992 Miyamoto et al. ..... 144/117 R

*Primary Examiner*—W. Donald Bray
*Attorney, Agent, or Firm*—Brooks & Kushman

[57] ABSTRACT

An automatic planning machine for cutting a surface of a workpiece which includes: a base portion on which the workpiece is to be laid; a feeding device for feeding the workpiece; a rotatable cutter block arranged on one side of the base portion with a rotary shaft substantially in a vertical direction; and a reference base disposed vertically on the other side of the base portion; wherein an upper side of a workpiece feeding path between the reference base and the cutter block is opened. A height of the reference base is lower than that of the cutter block and a top surface of the reference base is held horizontally. The automatic planning machine may comprise an auxiliary reference base which is detachably mountable on a top surface or a side wall of the reference base. The planning machine may further comprise a planing reference base disposed on a side of the cutter block, wherein the feeding device includes rotatable roller members each of which has a rotary axis substantially in a vertical direction, and spring members for pressing the workpiece, and a pressing device disposed in the reference base facing the planing reference base, for generating selectively a pressure which is larger than a pressure of the spring members of the roller members and a pressure which is smaller than the pressure of the spring members of the roller members to press the workpiece.

20 Claims, 25 Drawing Sheets

AUTOMATIC PLANING MACHINE

BACKGROUND OF THE INVENTION

The present invention relates to an automatic planing machine for cutting a workpiece flatly in an automatic manner. The present invention also relates to a workpiece guide device for an automatic planing machine.

In general, a substantially U-shaped automatic planing machine for cutting or planing a workpiece, in which a cutter block and the like are disposed horizontally, is widely well known. Thus, the workpiece must be laid on the cutter block disposed horizontally for cutting of the workpiece for determining a thickness of the workpiece. Also, it is sometimes impossible to cut or plane an end face of the workpiece due to the U-shaped structure of the conventional planing machine because of the retriction of a space for feeding the workpiece.

Further, due to the restriction of the workpiece feeding space, it would be impossible to plane the workpiece for determining a thickness of the work piece having a large width which is almost twice as large as a longitudinal length of the cutter block. Also, the conventional planning machine suffers from a problem that a stepped portion is generated in a machined surface due to an adverse effect of gravitational force of the workpiece. That is, a smooth cut surface cannot be obtained. Furthermore, the conventional plane suffers from a problem that it is impossible to effect end face machining or cutting of a workpiece having a large width.

SUMMARY OF THE INVENTION

In view of the foregoing defects inherent in the conventional planing machine, an object of the present invention is to provide an automatic planing machine with which it is possible to effect a cutting operation of a wide workpiece for determining a thickness of the workpiece, to enhance working precision, and to effect an end face cutting of the wide workpiece without enlarging a size of the planing machine.

According to the present invention, there is provided an automatic planing machine for cutting a surface of a workpiece, comprising: a base portion on which the workpiece is to be laid; a feeding device for delivering the workpiece; a rotatable cutter block arranged on one side of the base portion with a rotary shaft substantially in a vertical direction; and a reference base disposed vertically on the other side of the base portion; wherein an upper side of a workpiece feeding path between the reference base and the cutter block is opened. A height of the reference base is lower than that of the cutter block and a top surface of the reference base is held horizontally. The automatic planing machine may comprise an auxiliary reference base which is detachably mountable on a top surface or a side wall of the reference base. The planer may further comprise a planing reference base disposed on a side of the cutter block, wherein the feeding device includes rotatable roller means, disposed on the reference base, each of which has a rotary axis substantially in a vertical direction, and spring members for pressing the workpiece through the roller means, and a pressing device disposed in the reference base facing the planing reference base, for generating selectively a pressure which is larger than a pressure of the spring members of the roller means and a pressure which is smaller than the pressure of the spring members of the roller means to press the workpiece.

According to the present invention, the planing machine may further comprise a positioning and fastening means for selectively positioning and fastening the auxiliary reference base to a top surface and a side wall of the reference base, wherein the positioning and fastening means includes a pin fixed to the auxiliary reference base, holes formed in the reference base for selectively receiving the pin, and a rotatable shaft having an eccentric shaft to be brought into firm contact with the pin inserted into one of the holes.

With such an arrangement, according to the present invention, in order to effect a planing operation, the workpiece is laid on the base portion. Then, the workpiece is positioned in place by the reference base. At this time, by setting the pressing device so that the pressure of the spring members of the planing reference base is smaller than the pressure of the pressing device, the workpiece is held under the condition that the workpiece is depressed against the planing reference base. Under this condition, the roller members of the feeding device are rotated and the same time, the cutter block is also rotated. Then, the workpiece is fed by the roller members and the cutter block cuts the workpiece.

In order to effect the thickness determining work, by setting the pressing device so that the pressure of the spring members of the planing reference base is larger than the pressure of the pressing device on the reference base, the workpiece is held under the condition that the workpiece be depressed against the reference base. Under this condition, the roller members of the feeding device are rotated. Then, the workpiece on the base portion is fed by the roller members and the cutter block cuts the workpiece.

In order to effect the thickness determining work of the workpiece having a width which is almost twice as large as the longitudinal length of the cutter block, the lower half of the workpiece is first cut as described above, and thereafter, the workpiece is overturned up side down to effect the same cutting operation.

In order to effect the end face cutting operation of the wide workpiece, the auxiliary reference base is mounted on the side wall of the reference base. Under this condition, the workpiece is laid on the horizontal top surface of the reference base. Then, the cutter block is rotated to effect the end face cutting.

The auxiliary reference base is fixed to the reference base by the fastening means. The fastening means includes a pin formed in a surface, to contact the reference base, of the auxiliary reference base; a vertical position hole, formed in the top surface of the reference base, into which the pin may be inserted; a horizontal position hole, formed in the side wall of the reference base, into which the pin may be inserted; a circular hole in communication with the vertical position hole and the horizontal position hole; a fastening shaft which is inserted into the circular hole; and an eccentric shaft eccentrically fixed to the fastening shaft.

When the auxiliary reference base is fixed to the reference base by the fastening means, the pin is inserted selectively into the horizontal or vertical hole, and the fastening shaft is rotated. Thus, the position of the eccentric shaft is changed to press the pin to thereby fix the auxiliary base to the reference base.

In order to effect the thickness determining work, the positional adjustment between the cutter block and the vertical reference base is effected in advance and the cutting work is effected by feeding the workpiece between the vertical reference base and the cutter block.

In order to effect the end face cutting work, a distance between the cutter block and a scale disposed slidably on the auxiliary reference base is set in advance by effecting the positional adjustment of the scale, and the end face of the workpiece is cut or planed by feeding the workpiece on the horizontal reference base along the scale. Thus, both the thickness determining work and the end face cutting may be effected.

DESCRIPTION OF THE PREFERRED EMBODIMENTS

The present invention will now be described by way of examples with reference to the accompanying drawings.

Figure 1:
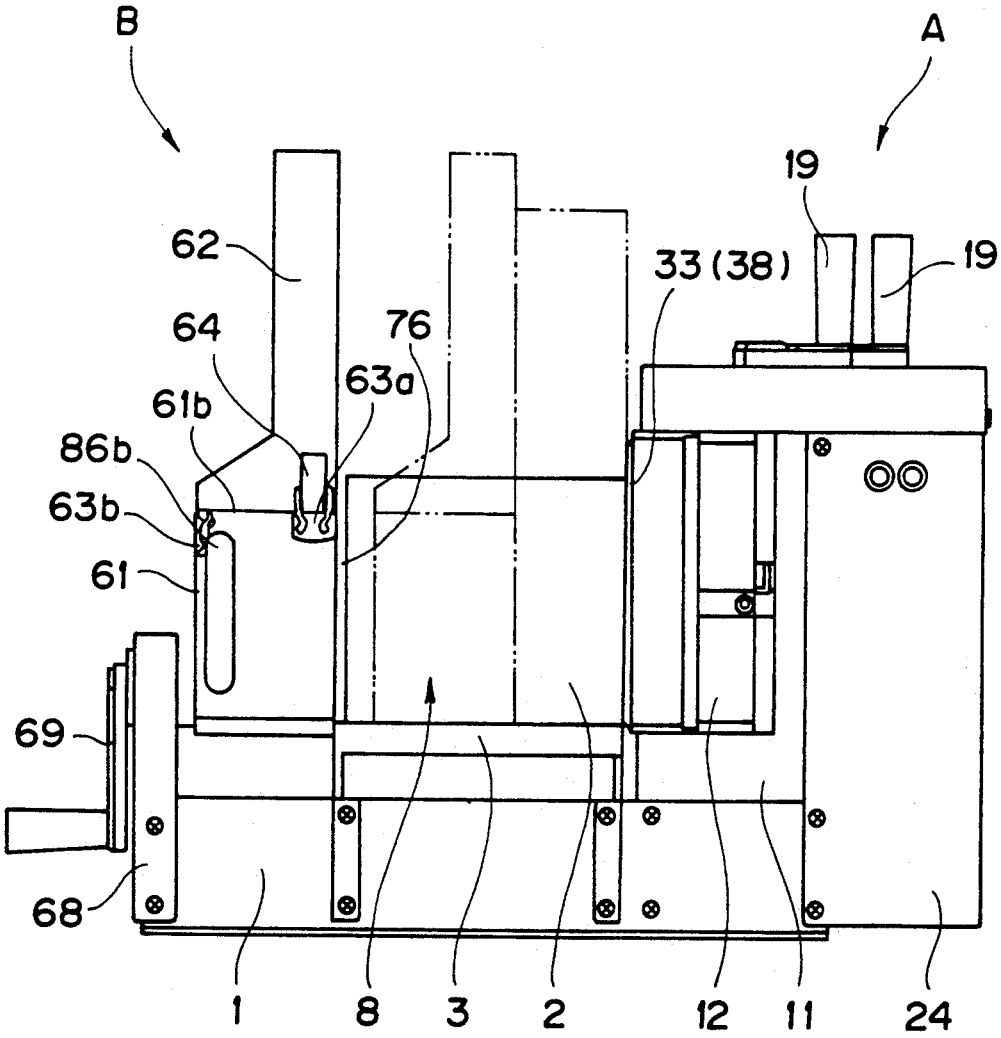
FIG. 1 is a frontal view showing an automatic planing machine according to the present invention.
Figure 2:
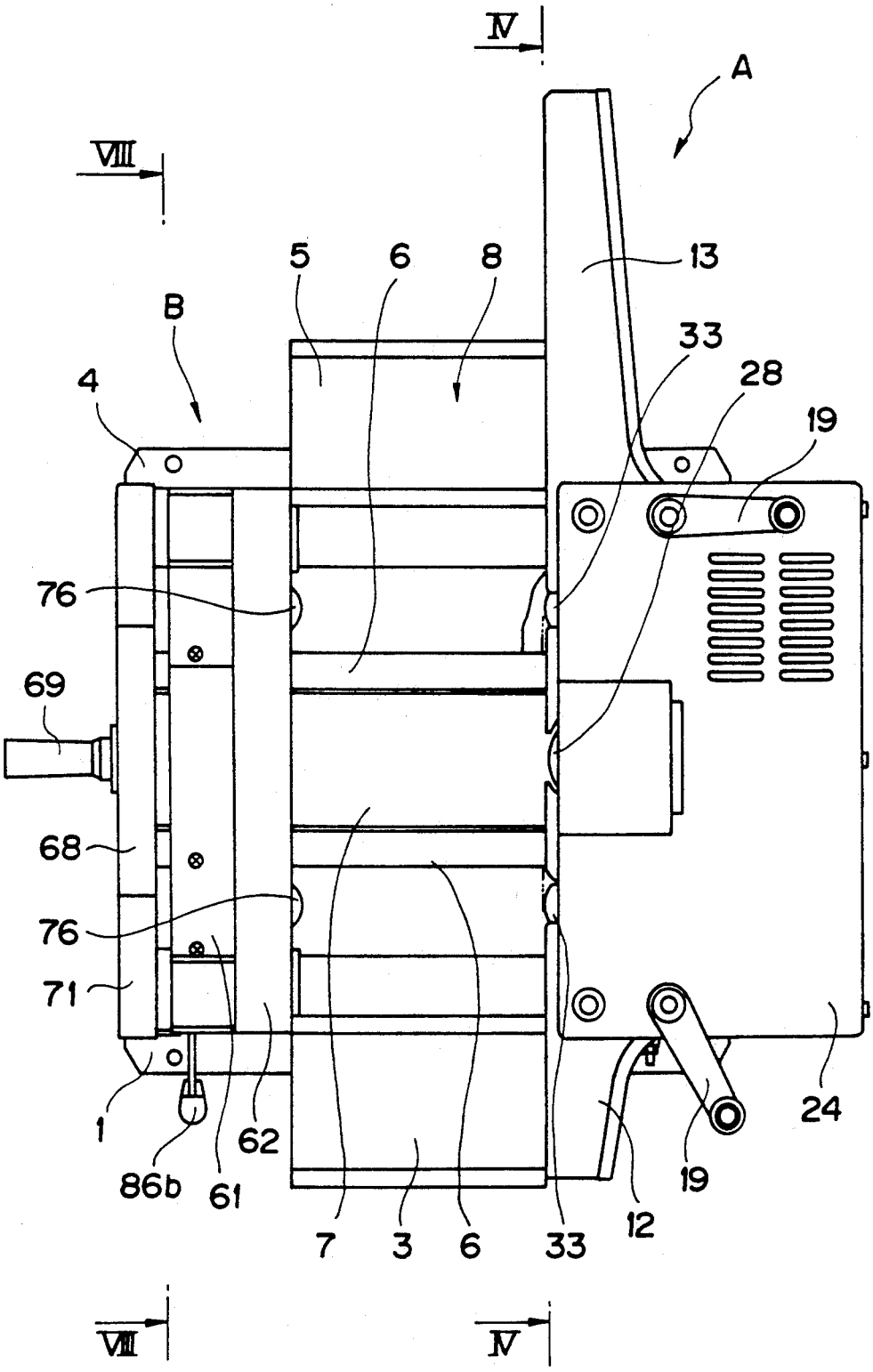
FIG. 2 is a plan view showing the automatic planing machine shown in FIG. 1.

FIG. 1 is a frontal view showing an automatic planing machine according to the present invention. FIG. 2 is a plan view of the planing machine shown in FIG. 1. In FIG. 1, a front guide 3 for guiding a delivery of a workpiece 2 to be cut is provided on a front base 1. As shown in FIG. 2, the front base 1 is connected to a rear base 4 through a bracket 71. In the same way, a rear guide plate 5 is provided on the rear base 4. Two auxiliary rollers 6 and, 6 and a receiving table 7 are provided between the guide plates 3 and front and rear. A feeding path 8 for delivering the workpiece 2 during the cutting operation is defined by the front guide plate 3, the rear guide plate 5, the auxiliary rollers 6 and the receiving table 7. A planing base section A for planing a surface is formed on the right side of the delivery path 8 in FIG. 1.

Figure 3:
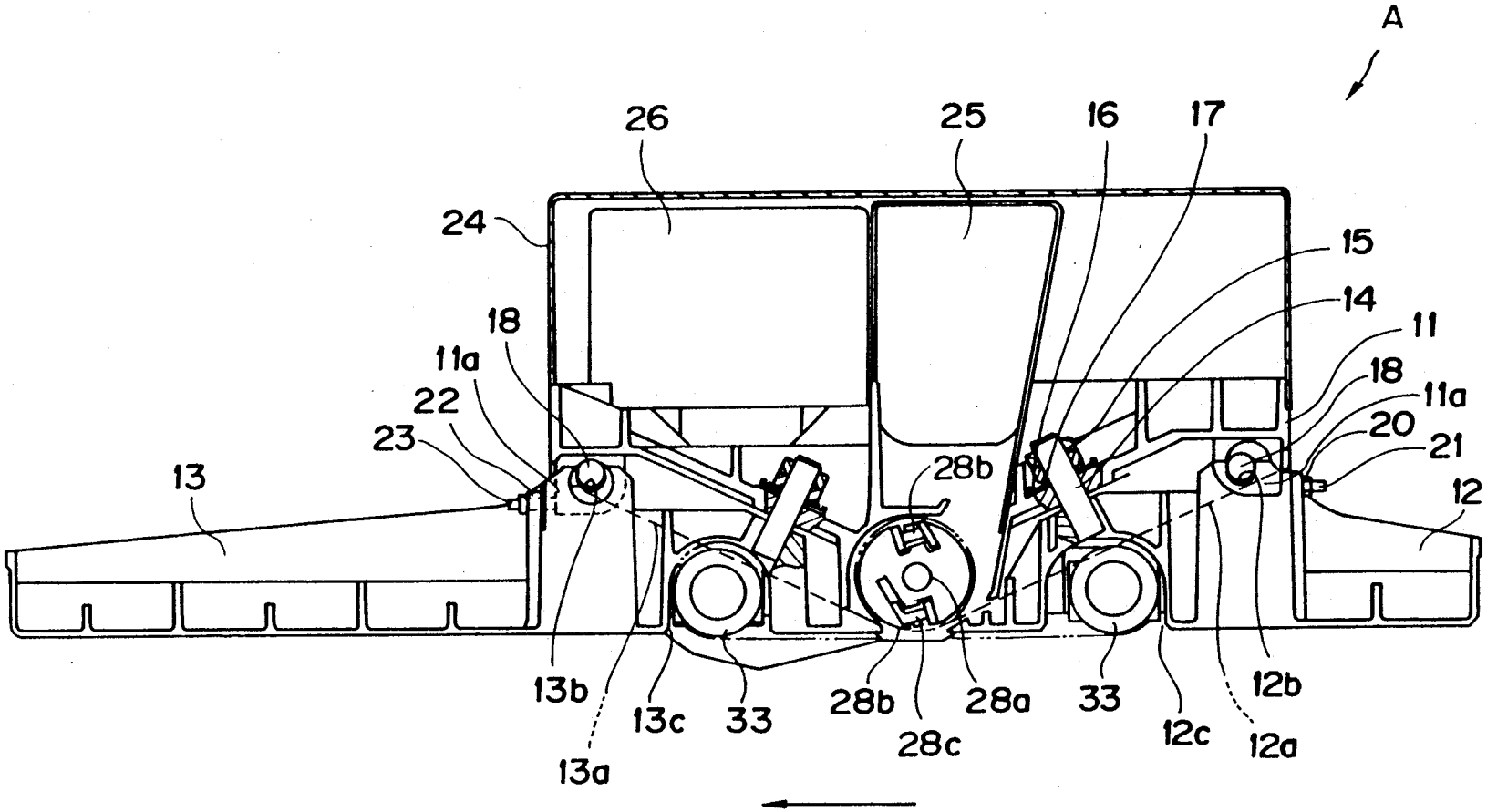
FIG. 3 is a plan view showing a planing section of the automatic planing machine shown in FIGS. 1 and 2.
Figure 4:
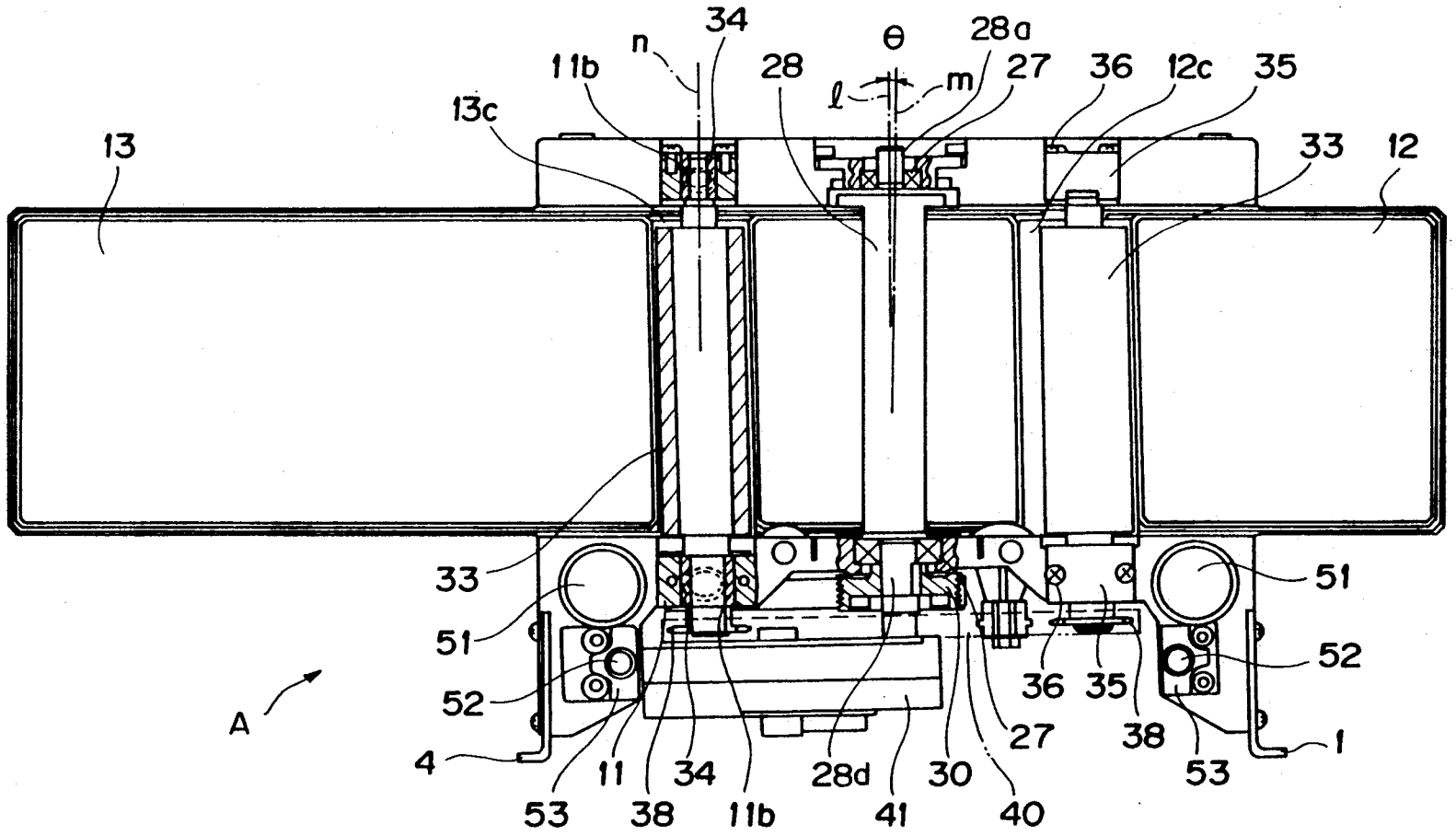
FIG. 4 is a view as viewed from the line VI—VI of FIG. 2.

The planing reference base section A will now be described in detail. FIG. 3 is a plan view showing the reference base section A. FIG. 4 is a view as viewed from the line IV—IV of FIG. 2. A roller case 11 is coupled to the front base 1 and the rear base 4 by bolts (not shown) (see FIG. 2). A front reference base 12 and a rear reference base 13 which constitute the planing base section A are attached to front and rear portions of the roller case 11 in the feeding direction (indicated by the arrow in FIG. 3) of the workpiece. The front and rear reference bases 12 and 13 abuts against the roller case 11 through slant surfaces 12*a* and 13*a* at predetermined angles on both the right and left sides and are pressingly held thereto by stud bolts 14, nuts 15, slide plates 16 and seats 17. Receiving portions 11*a*, 11*a* are formed at front and rear positions which face the front reference base 12 and the rear reference base 13 of the roller case 11, respectively. Eccentric shafts 18, 18 are rotatably supported in the receiving portions 11*a*, 11*a*. The eccentric shafts 18 are engaged with grooves 12*b* and 13*b* formed in the front and rear reference bases 12 and 13, respectively. The eccentric shafts 18 are rotated by operating handles 19, 19 connected to the eccentric shafts 18, 18 (see FIGS. 1 and 2) when the eccentric shafts 18 are rotated by the operating shafts 19, the front and rear reference bases 12 and 13 are moved along the slant surfaces 12*a* and 13*a*, respectively thereby to adjust the positions of the respective reference surfaces contacting the surface, to be cut, of the workpiece with respect to the cutter block 28. This makes it possible to adjust a cutting amount of the workpiece. A stop screw 21 is threadedly engaged with the front reference base .12 with a nut. The receiving portion 11*a* of the roller case 11 abuts against the left end portion of the stop screw 21 in FIG. 3. Therefore, the front reference base 12 is prevented from moving to the left in FIG. 3 beyond a predetermined distance. In the same way, a stop screw 23 is provided in the rear reference base 13 with a nut 22, so that the rear reference base 13 is prevented from moving to the right beyond a predetermined distance.

A cover 24 is provided on an upper portion of the roller case 11 as shown in FIG. 3. A dust cover 25 and a drive motor 26 are received in the cover 24.

Figure 5:
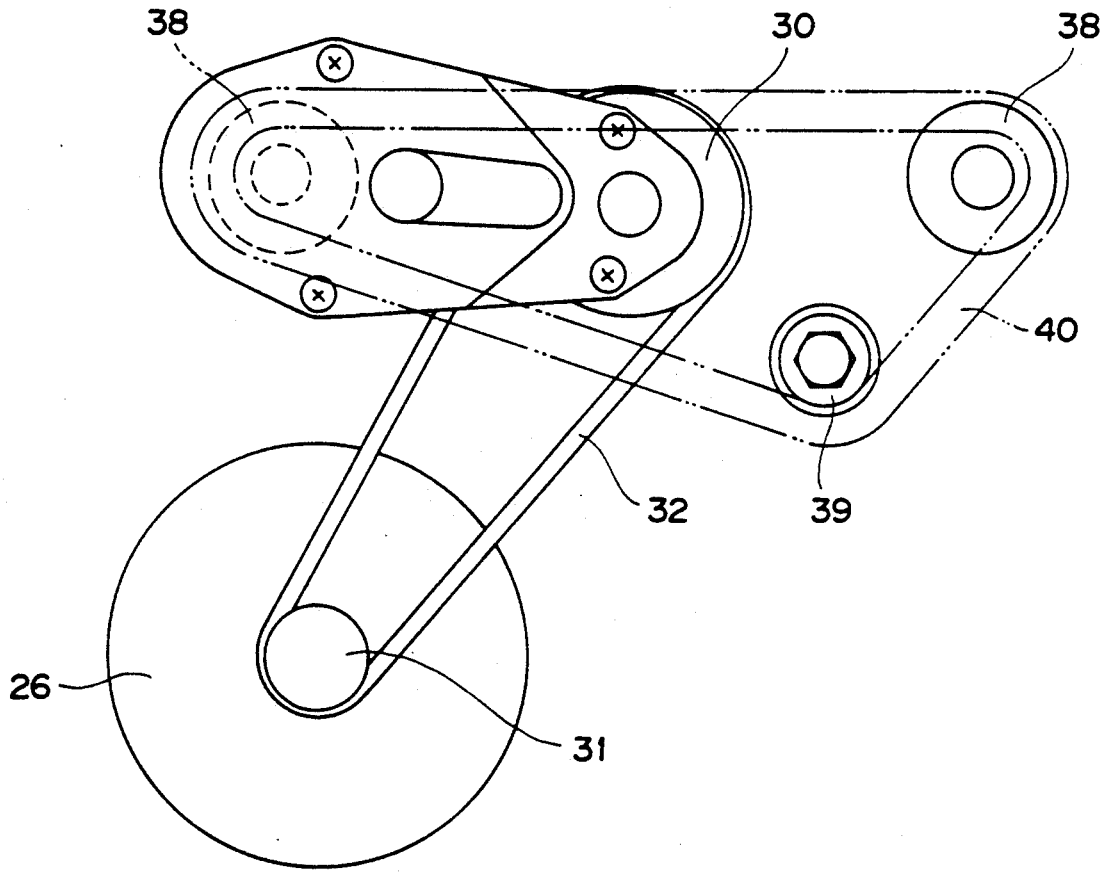
FIG. 5 is a schematic view showing a rotational drive mechanism for a cutter block and feed rollers according to the present invention.

A cutter block 28 is rotatably provided at the roller case 11 through bearings 27 and 27 (FIG. 4). A rotary shaft 28*a* of the cutter block 28 is slanted at a slight angle with respect to a vertical line m in the feeding direction. As best shown in FIG. 3, the cutter block 28 is composed of a block body 28*a*, a pair of blades 28*b* and 28*b* and a cutter presser 28*c* for pressing the blades 28*b*. A large pulley 30 is provided on a rotary shaft 28*d* disposed in the lower portion of the cutter block 28 as shown in FIG. 4. As shown in FIG. 5, a belt 32 is laid between the large pulley 30 and a small pulley 31 provided on the drive motor 26. Thus, the rotational torque is applied to the cutter block 28.

On the other hand, two recesses 12*c* and 13*c* are formed in the front reference base 12 and the rear reference base 13, respectively, as shown in FIG. 3. Two feed rollers 33 and 33 are received in the recesses 12*c* and 13*c*, respectively. The feed rollers 33 are used to feed the workpiece during the cutting operation. The direction of the axis m in FIG. 4 is in parallel with the axis 1 of the cutter block 28 so that the workpiece is depressed to the receiving table 7 during the cutting operation.

Figure 6:
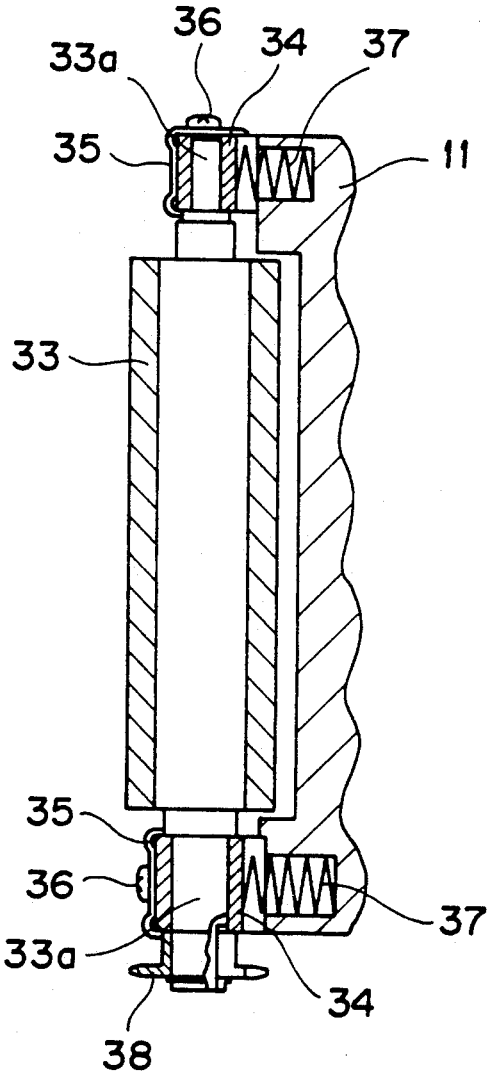
FIG. 6 is a cross sectional view showing a support mechanism for the feed rollers of the automatic planing machine according to the present invention.

The feed rollers 33 are supported on the roller case 11 in the following manner. Namely, square metals 34 are provided in square holes 11*b* formed in the roller case 11. As shown in FIG. 6, the shaft portions 33*a* of the feed rollers 33 are rotatably provided within the square metals 34. Holder plates 35 are fixed to the roller case 11 by screws 36 so as to cover the above described square holes (see FIG. 4). Coil springs 37 are interposed between the right ends of the square metals 34 and the roller case 11 so that the feed rollers 33 are biased toward the left in FIG. 6 under a predetermined force. A sprocket 38 is provided at one shaft portion 33*a*. A chain 40 is laid through a tension roller 39 between the two sprockets 38 provided on the two feed rollers 33. The two sprockets 38 has the same number of the teeth so as to have the same rotational speed.

Figure 7:
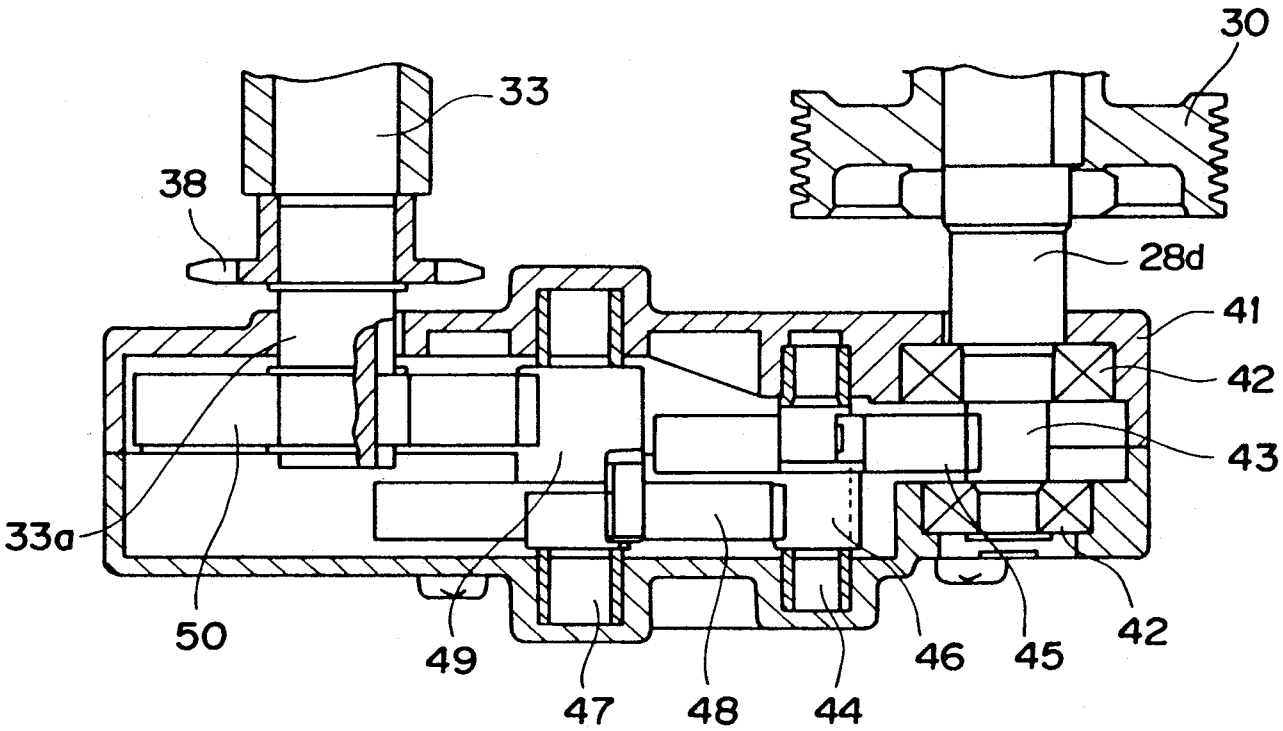
FIG. 7 is a cross sectional view showing a speed reduction mechanism of the feed rollers of the planing machine according to the present invention.

As shown in FIG. 4, a gear case 41 in which encased is a gear train forming a speed reduction mechanism is arranged below the rotary shaft 28*b* of the cutter block 28 and the shaft portion 33*a* of the feed roller 33. FIG. 7 is a cross sectional view showing an interior of the gear case 41. More specifically, the rotary shaft 28*d* is rotatably supported by bearings 42 provided within the gear case 41. A small gear 43 is provided on the rotary shaft 28*d*. Further, the small gear 43 meshes with a large gear 45 fixed to a shaft 44 rotatably supported by the gear case 41. A small gear 46 is fixed to the shaft 44 and is adapted to mesh a large gear 48 fixed to a shaft 47 rotatably supported to the gear case 41. A small gear 49 is fixed to the shaft 47 and is adapted to mesh a large gear 50 fixed to the shaft portion 33*a* of the feed roller 33. With such an arrangement, as shown in FIG. 5, the rotational force of the drive motor 26 causes the large pulley 30 to rotate through the belt 32. As a result, the cutter block 28 is rotated. In FIG. 7, the rotation of the large pulley 30 is transmitted in a speed reduction manner through the small gear 43, the large gear 45, the small gear 46, the large gear 48, the small gear 49 and the large gear 50 to thereby rotate the feed roller 33. As shown in FIG. 5, the rotation of the feed roller 33 causes the other sprocket 38 to rotate through the chain 40 laid between the sprockets 38 with a suitable tension, thereby rotating the two feed rollers 33.

Reference numeral 51 in FIG. 4 denotes a guide bar for serving as a guide for moving toward and away from a thickness determining reference base section B. The guide bars 51 each extends in the right and left directions in FIG. 1. Reference numeral 52 in FIG. 4 denotes a feed screw which each also extends in the right and left directions in FIG. 1. Leaf springs 53 for cancelling the backlash are interposed between the shaft support portions of the feed screws 52 and the roller case 11.

A structure of the thickness determining reference base section B will now be described in detail.

Figure 8:
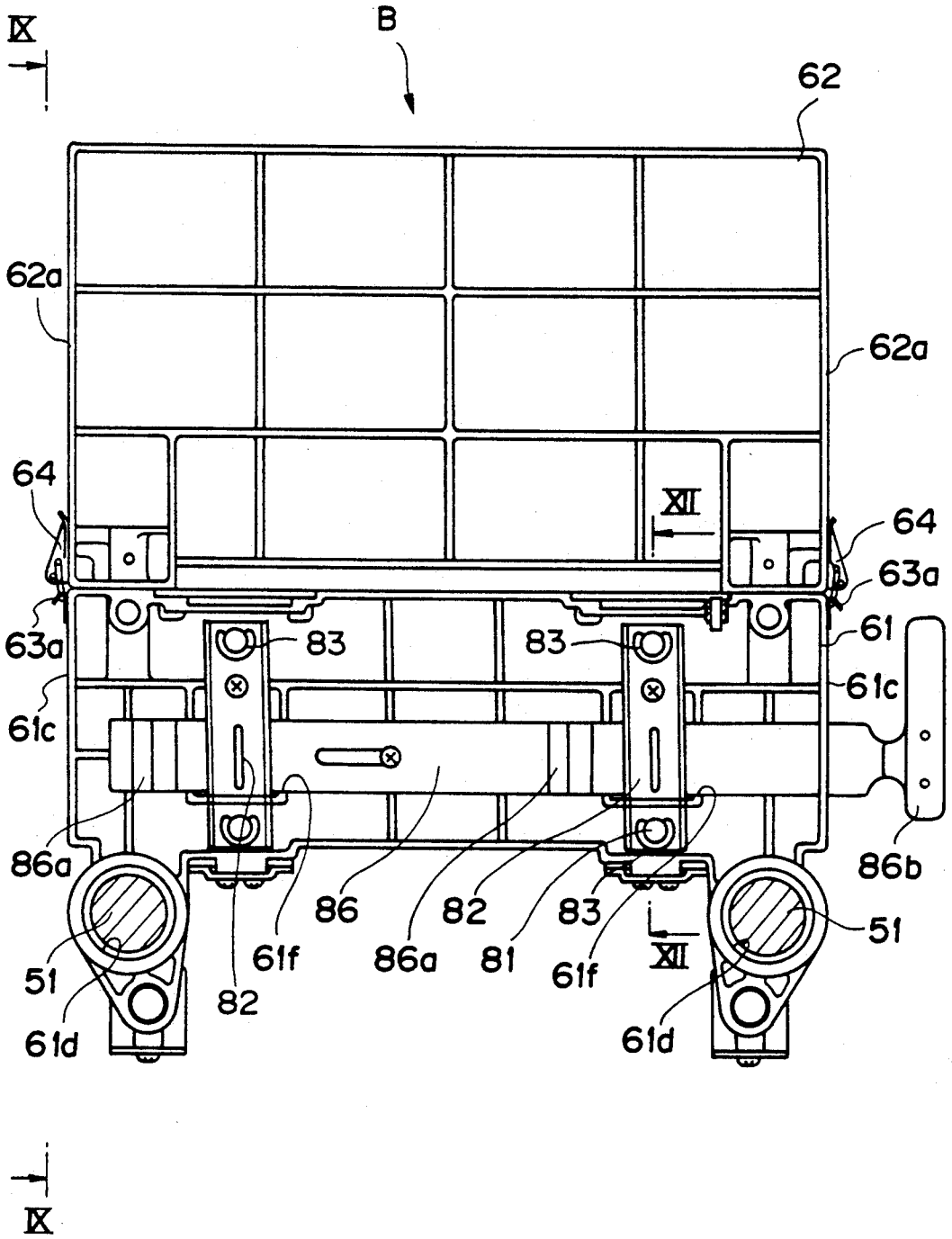
FIG. 8 is a side elevational view, as viewed from the line VIII—VIII of FIG. 2, showing the thickness determining section of the automatic planing machine according to the present invention.
Figure 9:
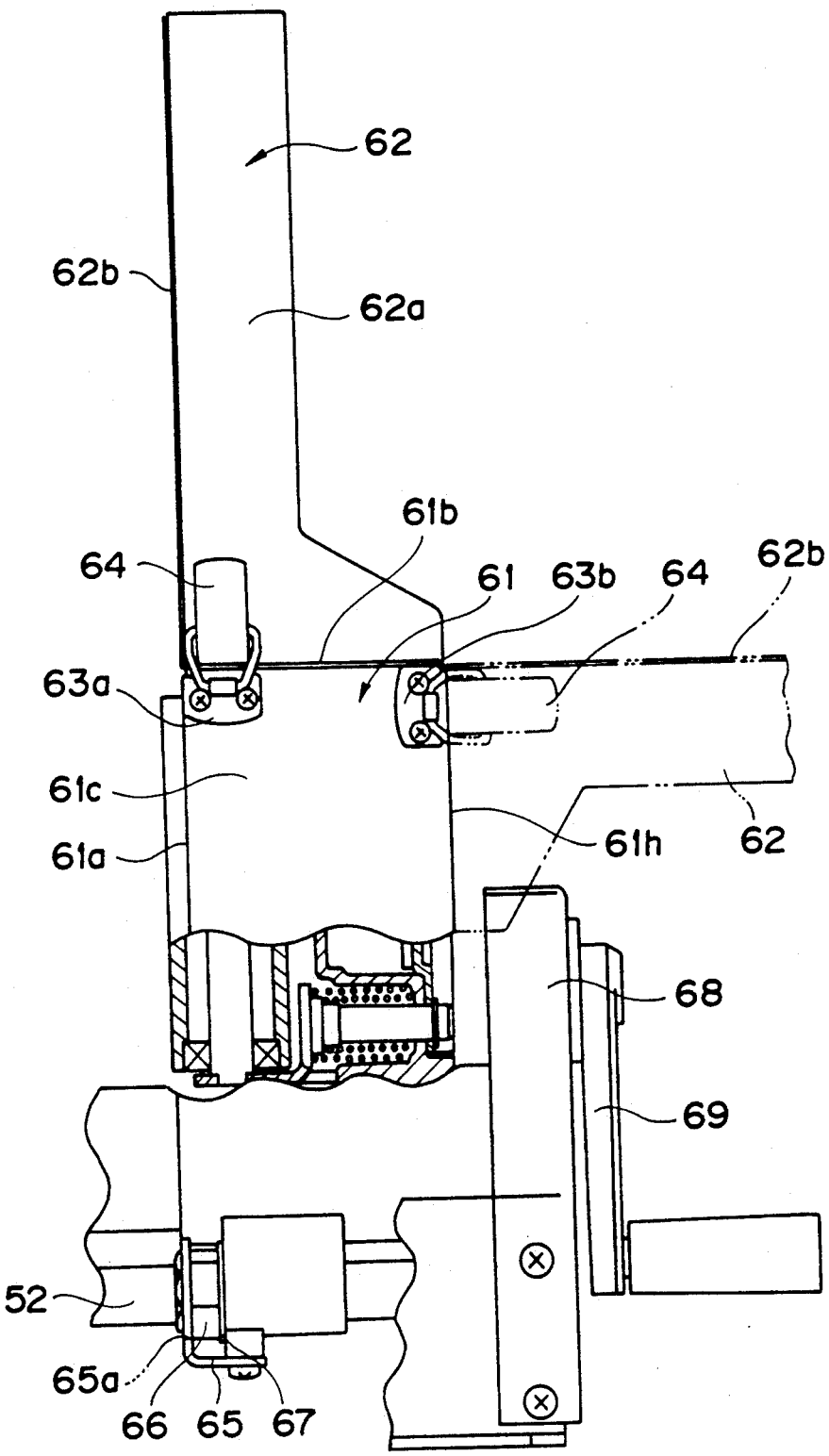
FIG. 9 is a view as viewed from the line IX—IX of FIG. 10.
Figure 13:
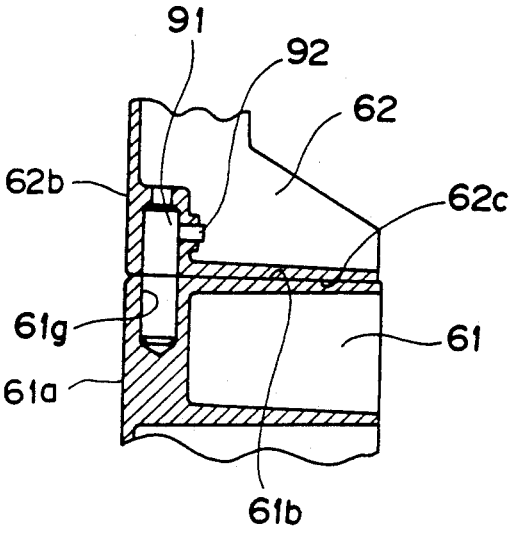
FIG. 13 is a schematic cross sectional view showing a positioning mechanism of the auxiliary reference base of the automatic planing machine according to the present invention.

FIG. 8 is a view as viewed from the line VIII—VIII of FIG. 2, and FIG. 9 is a view as viewed from the line IX—IX of FIG. 8. Reference numeral 61 denotes a reference base for determining the thickness. A reference base surface 61*a* which is to come into contact with a workpiece to be cut is formed in the thickness determining reference base 61 on the delivery path side (i.e., the left side in FIG. 9). A top surface 61*b* of the reference base 61 is set to be horizontal, and the top surface 61*b* is lower in height than the cutter block 28 of the section A (see FIG. 1). A vertical position click buckle key hook 63*a* (shown by solid lines in FIG. 9) for mounting an auxiliary reference base 62 in a vertical position and a horizontal position click buckle key hook 63*b* (shown by tow dot and dash lines in FIG. 9) for mounting the auxiliary reference base 62 in a horizontal position are provided in a side wall 61*c* of the thickness determining reference base 61. A click buckle key 64 which may selectively engage with the vertical position click buckle key hook 63*a*, and the horizontal position click buckle key hook 63*b* is provided on a side wall of the auxiliary reference base 62. The mounting positions of the above described click key hooks 63*a* and 63*b* and the click key 64 are selected so that, when the auxiliary reference base 62 is mounted on the reference base 61, the reference surface 61*a* of the reference base 61 and the reference surface 62*b* of the auxiliary reference base 62 are flush with each other (as indicated by the solid lines in FIG. 9) and the top surface 61*b* of the reference base 61 and the top surface 61*b* of the auxiliary reference base 62 are flush each other (as shown in two dot and dash lines in FIG. 9). FIG. 13 is a cross sectional view showing the structure for positioning the auxiliary reference base 62 in place. Namely, a pin 91 is provided at the contact portion 62*c* of the auxiliary reference base 62. The pin 91 is fixed to the auxiliary reference base 62 by a stop screw 92. A vertical position determining hole 61*g* into which the pin 91 is insertable is formed at a predetermined position of the top surface 61*b* of the reference base 61. By inserting the pin 91 into the vertical position determining hole 61*g*, it is possible to position the auxiliary reference base 62 in a desired vertical position. Also, a horizontal position determining hole (not shown) for positioning the auxiliary reference base 62 so that the top surface 61*b* of the base 61 and the reference surface 62*b* of the auxiliary reference base 62 are flush with each other is formed in a predetermined position of an opposite surface 61*h* (FIG. 9) of the reference base 61.

On the other hand, in the foregoing embodiment, when the auxiliary reference base 62 is laid in the vertical position, a length of the reference surface 62*b* of the auxiliary reference base 62 is twice as large as a height of the thickness determining reference base 61.

Figure 10:
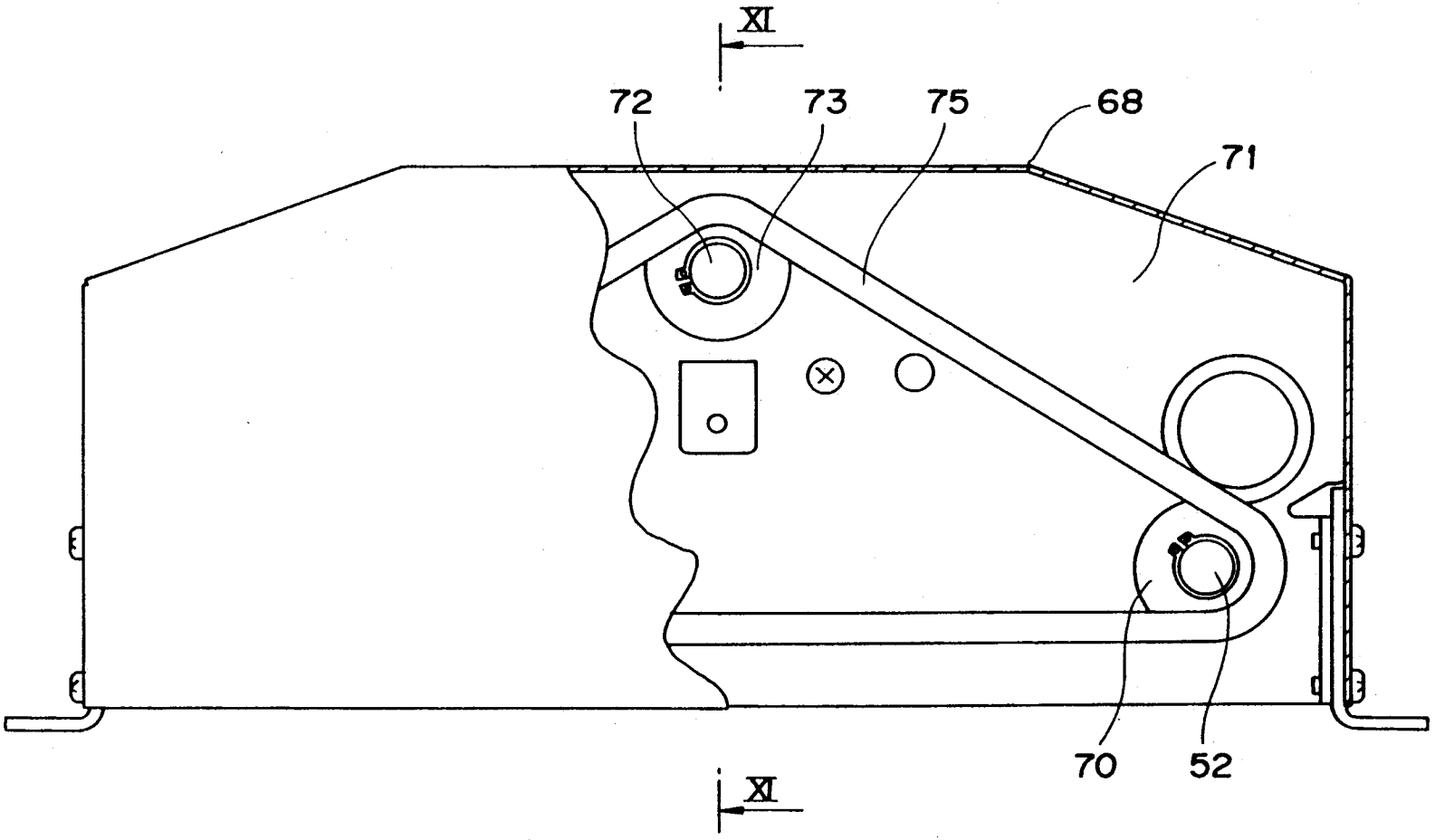
FIG. 10 is a schematic view showing a rotational drive mechanism for the feed rollers of the automatic planing machine according to the invention.
Figure 11:
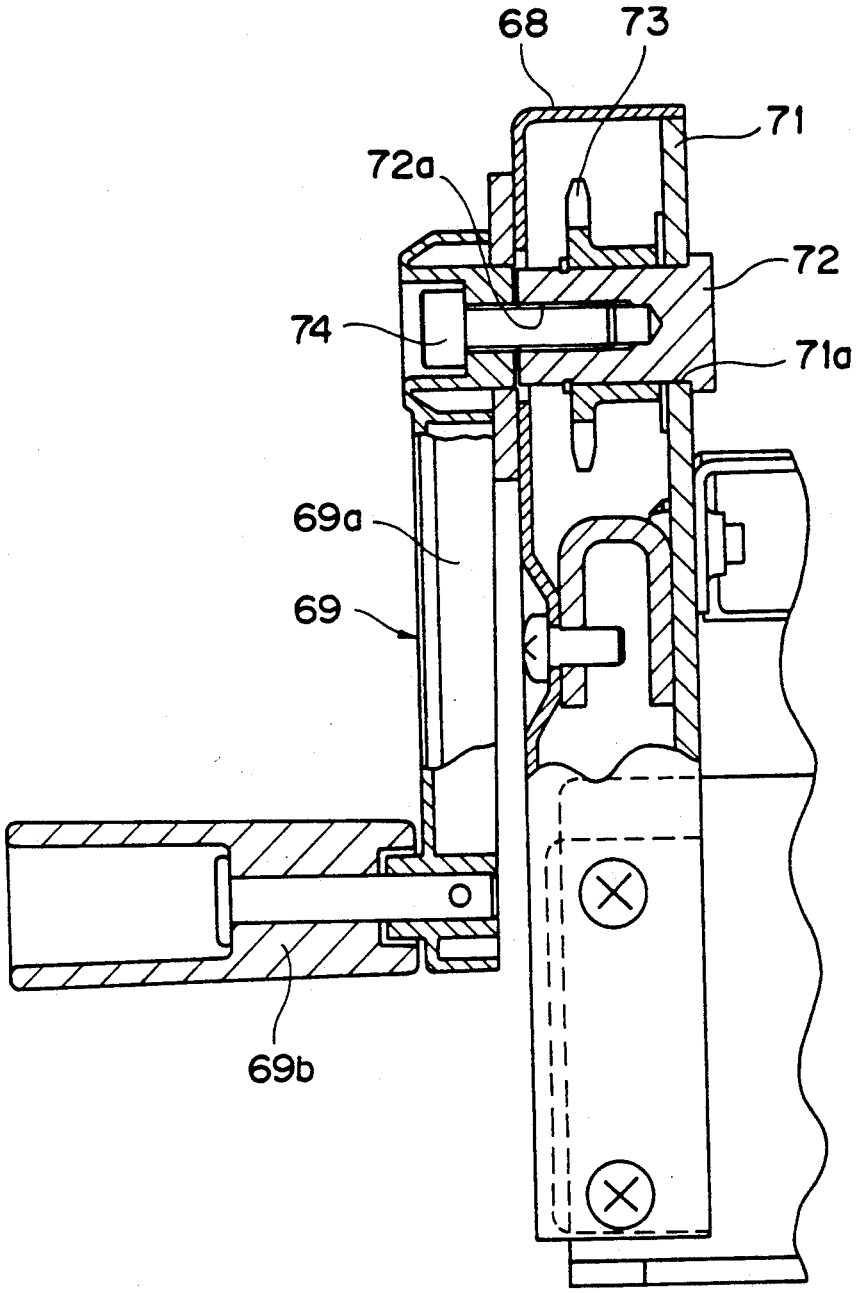
FIG. 11 is a view as viewed from the line XI—XI of FIG. 10.

Turning back to FIG. 8, the guide bars 51 (FIG. 4) provided in the roller case 11 on the section A are inserted into the thickness determining reference base 61, and guide holes 61*d* which are slid relative to the guide bars 51 during the movement for positioning the thickness determining reference base 61 are formed in the reference base 61. In FIG. 9, a holder plate 65 is formed in the reference base 61, and a polygonal hole 65*a* which may engage with a nut 66 is formed in the holder plate 65. The nut 66 is prevented from rotating by the polygonal hole 65*a*. A leaf spring 67 for cancelling the backlash is interposed between the reference base 61 and the nut 66. The driving rotation of the feed screw 52 is effected by the rotation of a handle 69 through a transmission mechanism formed in a cover 68. FIG. 10 is a cross sectional view showing the interior of the cover 68, and FIG. 11 is a cross sectional view taken along the line XI—XI of FIG. 10. In FIG. 10, a sprocket 70 is fixed to the feed screw 52. A hole 71*a* is formed in a bracket 71 fitted in the cover 68 as shown in FIG. 11. A sprocket shaft 72 is inserted into the hole 71*a*. A sprocket 73 is fixed to an outer periphery of the sprocket shaft 72. A screw hole 72*a* is formed in the sprocket shaft 72. A bolt 74 is fastened to the screw hole 72*a* so that one end of an arm portion 69*a* of the handle 69 is fixed in place. A grip portion 69*b* is provided at the other end of the arm portion 69*a*. As best shown in FIG. 10, a chain 75 is laid between two sprockets 70 one of which has not been shown and the sprocket 73. Then, by rotating the handle 69, the sprocket 73 is rotated, and further, the sprockets 70 are rotated through the chain 75, thereby rotate the feed screws 52 and moving the reference base 61.

Figure 12:
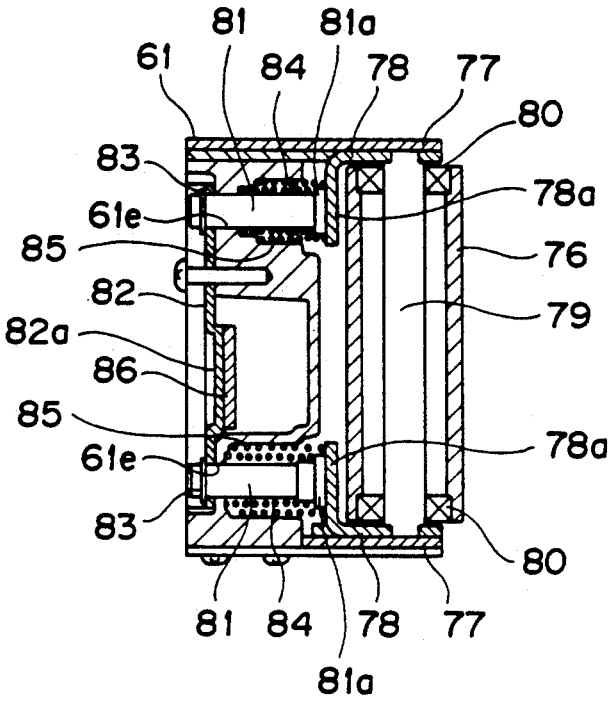
FIG. 12 is a schematic view showing a pressure switching mechanism of the pressing rollers of the automatic planing machine according to the present invention and a cross sectional view taken along the line of XII—XII of FIG. 8.

As shown in FIG. 2, two pressing rollers 76 and 76 are provided on the thickness determining reference base 61. The mounting structure of the pressing rollers 76 will now be described in detail with reference to FIGS. 8 and 12. FIG. 12 is a sectional view taken along the line XII—XII of FIG. 8. Reference numeral 77 and 77 in FIG. 12 denote upper and lower plates. Support plates 78 and 78 which face each other are provided slidingly relative to the plates 77 and 77. Support shaft 79 is fixed to the support plates 78 under the condition that its axial direction be slanted at a predetermined angle relative to the feeding direction of the workpiece with respect to the vertical direction. The pressing roller 76 which is a hollow member is rotatably supported, at its upper and lower end, by the support shaft 79 through two bearings 80 and 80.

On the other hand, in FIG. 12, stop pins 81 are inserted movably in the axial direction in holes 61*e* formed in the thickness determining reference base 61. The stop pins 81 are inserted into a single adjustment plate 82, and stop rings 83 projected to the left in FIG. 12 are fixed to the adjustment plate 82 to thereby prevent the stop pins 81 from moving to the right in FIG. 12. A pressing portion 81*a* is formed at the right end of each stop pin 81 and is brought into contact with a bent portion 78*a* formed in the support plate 78. A first coil spring 85 is interposed between each bent portion 78*a* of the support plate 78 and the associated stepped portion of the hole 61*e*. A second coiled spring 84 is interposed between the pressing portion 81*a* of each stop pin 81 and a stepped portion of the associated hole 61*e* to thereby press the pressing portion 81*a* against the bent portion 78*a* in each second coil spring 84 to thereby normally press the pressing roller 76 to the right in FIG. 12 through the support plate 78.

The spring force of the first coiled springs 85 is smaller than that of the feed rollers 33 (FIG. 6) provided on the roller case 11. The spring force of the coiled springs 37 is smaller than that of the second coiled springs 84.

An operating plate 86 extending in the right and left directions in FIG. 8 is provided movably in the right and left directions in guide portions 61*f* of the thickness determining reference base 61. The operating plate 86 is in contact with each contact portion 82*a* of the two adjustment plates 82 as shown in FIG. 12. Two raised portions 86*a* and 86*a* formed at predetermined positions of the operating plate 86. A handle 86*b* is formed at the right end portion in FIG. 8 for moving the operating plate 86 in the right and left directions in FIG. 8.

The operation of the thus constructed automatic planing machine will be described in detail.

The case where a planing operation is effected will first be described. First of all, each handle 19 shown in FIGS. 1 and 2 is rotated to rotate the eccentric shaft 18 coupled to the handle 19 (FIG. 3). Thus, since the eccentric portions of the eccentric shafts 18 are engaged with the grooves 12*b* and 13*b* formed, respectively, in the front and rear reference bases 12 and 13, the front and rear reference bases 12 and 13 are moved along the slant surfaces 12*a* and 13*a*. It is therefore possible to adjust the cutting amount of the workpiece.

The thickness determining section B is moved to the right in FIG. 1 and the handle 69 is rotated so that the width of the feeding path 8 is identical with the width of the workpiece 2. In other words, by rotating the handle 69, the sprocket shaft 72 and the sprocket 73 are rotated as shown in FIG. 10. Then, the chain 75 is driven and hence, the sprockets 70 provided on the feed screws 52 are rotated. Then, the feed screws 52 are also rotated to move the thickness determining reference base 61, so that it is possible to adjust the width of the delivery path 8.

In order to effect the planing operation, the pressure of the pressing roller 76 shown in FIG. 12 is adjusted. The adjustment operation will now be described. Namely, FIG. 8 shows a state wherein the raised portions 86*a* of the operating plate 86 are not in contact with the contact portions 82*a* of the adjustment plate 82. At this time the pressing portions 81*a* of the pressing pins 81 contacts the bent portions 78*a* of the support plates 78, as shown in FIG. 12, so that the pressure of the second coiled springs 84 interposed between the reference base 61 and the pressing portions 81*a* is applied to the pressing roller 76. Accordingly, the pressure of the first coiled springs 85 and the second coiled springs 84 is applied to the pressing roller 76.

Under this condition, the drive motor 26 shown in FIGS. 3 and 4 is operated to rotate the small pulley 31 (in FIG. 5). The rotation of the small pulley 31 is applied to the cutter block 28 (in FIG. 4) through the belt 32 to rotate the large pulley 30 (FIG. 5). Thus, the cutter block 28 is rotated. The rotation of the rotary shaft 28*b* coupled to the cutter block 28 is applied to the sprockets 38 provided on the feed rollers 33 through the speed reduction gear train encased in the gear case 41. In FIG. 5, since one of the sprockets 38 is rotated, the other is rotated to thereby rotate two feed rollers 33 (FIG. 4).

Then, in FIG. 2, the workpiece 2 is laid on the guide plate 3 and pushed forward (in FIG. 2). Thereafter, the workpiece 2 is interposed and clamped between the feed rollers 33 on the reference base section A and the pressing rollers 76 on the thickness determining section B. At this time, the pressing rollers 76 are depressed by the first coiled springs 85 and the second coiled spring 84 (FIG. 12). The pressure is larger than the pressure of the coiled springs 37 (FIG. 6) for pressing the feed rollers 33. Therefore, the workpiece 2 is depressed to the right in FIG. 2 and is in contact with the front reference base 12 of the section A. Under this condition, the cutting operation of planing is applied to the workpiece 2 by the cutter block 28. The workpiece 2 is fed forward (in FIG. 2). The cutting chips or wastes generated by this cutting operation are discharged into the dust cover 25 (FIG. 3) received in the cover 24. Thus, the planing operation is performed.

The operation of the thickness determining machining will be described. In the same way as the planing operation, each handle 19 shown in FIGS. 1 and 2 is rotated, and the front reference base 12 and the rear reference base 13 are moved. In the same way as the planing operation, the positional adjustment of the thickness determining section B is effected so that the width of the workpiece 2 and the width of the feeding path 8 are made identical with each other.

Furthermore, in order to effect thickness determining machining, the pressure of the pressing rollers 76 shown in FIG. 12 is adjusted. The adjustment work will be described in detail. Namely, in FIG. 8, the handle 86*b* of the operating plate 86 is moved in the right direction so that the raised portions 86*a* of the operating plate 86 is brought into contact with the contact portions 82*a* of the adjustment plates 82 (FIG. 12). The adjustment plates 82 are moved to the left in FIG. 12, whereby the stop pins 81 are moved also to the left through the stop rings 83. As a result, the pressing portions 81*a* of the stop pins 81 are separated away from the bent portions 78*a* of the support plates 78 and the pressure of the second coiled springs 84 interposed between the thickness determining reference base 61 and the pressing portions 81*a* is not applied to the pressure rollers 76. Accordingly, only the pressure of the first coiled springs 85 is applied to the pressure rollers 76.

Under this condition, the drive motor shown in FIG. 3 is operated to rotate the cutter block 28 (FIG. 4) and the two feed rollers 33 in the same way as in the case of the above described planing operation.

Then, in FIG. 2, the workpiece 2 is laid on the guide plate 3 and is pushed forward (in FIG. 2). Thereafter, the workpiece 2 is interposed and clamped between the feed rollers 33 on the reference base section A and the pressing rollers 76 on the thickness determining section B. At this time, the pressing rollers 76 are depressed only by the first coiled springs 85 (FIG. 12). The workpiece 2 is depressed at a smaller pressure then that of the coiled springs 37 (FIG. 6) for pressing the feed rollers 33. As a result, the workpiece 2 is depressed to the left in FIG. 2 and is brought into contact with the reference surface 61*a* of the thickness determining reference base 61 (FIG. 9). Under this condition, the workpiece 2 is subjected to the cutting operation for the thickness determining operation by the cutter block 28. The wastes or chips generated in this operation are discharged into the dust cover 25 (FIG. 3) encased in the cover 24. Thus, the thickness determining machining is effected.

The thickness determining operation in the case where the surface, to be cut, of the workpiece 2 is longer than a longitudinal length of the cutter block (as indicated by two dots and dash lines in FIG. 1) will be explained.

In this case, in FIG. 13, the pin 91 fixed to the auxiliary reference base 62 is inserted into the vertical position hole 61*g* formed in the top surface 61*b* of the thickness determining reference base 61, and the auxiliary reference base 62 is positioned so that the reference surface 61*a* of the thickness determining reference base 61 and the reference surface 62*b* of the auxiliary reference base 62 are flush with each other (FIG. 9). Then, in FIG. 1, the click buckle key 64 of the auxiliary reference base 61 is engaged with the vertical click buckle key hook 63*a* provided on the thickness determining reference base 61. Thus, the auxiliary reference base 62 is held in the vertical position. Also, in the same way as in the foregoing cases, the positional adjustment of the front and rear reference bases 12 and 13 and the positional adjustment of the thickness determining reference base 61 are effected. Furthermore, in response to the thickness determining machining, the pressure of the pressure rollers is adjusted.

Under this condition, the drive motor 26 is operated to drivingly rotate the cutter block 28 and the two feed rollers 33.

Then, the workpiece 2 is laid on the front guide plate 3 and is pushed forward (in FIG. 2). Thus, the lower part of the workpiece 2 on the right side in FIG. 1 is cut. Thereafter, in order to effect the cutting of the upper portion on the right side in FIG. 1, the workpiece is overturned up side down, and the like cutting operation is effected. During the cutting operation, it is possible to stably feed the workpiece 2 by the auxiliary reference base 62. Also, it is possible to effect the cutting operation of a workpiece having a large width with ease.

The operation for machining an end face of the workpiece 2 will be described in detail with reference to FIG. 14.

In this case, the pin (FIG. 13) fixed to the auxiliary reference base 62 is inserted into a horizontal positioning hole (not shown) formed in the opposite surface 61*h* of the thickness determining reference base 61 (FIG. 9), so that the top surface 61*b* of the thickness determining reference base 61 and the reference surface 62*b* of the auxiliary reference base 62 are flush with each other. The click buckle key 64 of the auxiliary reference base 62 is engaged with the horizontal click buckle key hook 63*b* provided on the thickness determining reference base 61 so that the auxiliary reference base 62 is held in the horizontal position. Also, in the same way as in the foregoing cases, the positional adjustment of the front and rear reference bases 12 and 13 is effected. Under this condition, the drive motor 26 shown in FIG. 3 is operated to rotate the cutter block 28 and the two feed rollers 33.

The workpiece 2 is laid on the top surface 61*b* of the reference base 61 and the reference surface 62*b* of the auxiliary reference base 62, and the end face 2*a* of the workpiece is brought into contact with the cutter block 28 (FIG. 3). Under this condition, the workpiece 2 is pushed forward (in FIG. 2). Thus, the end face of the workpiece 2 is cut.

Figure 15:
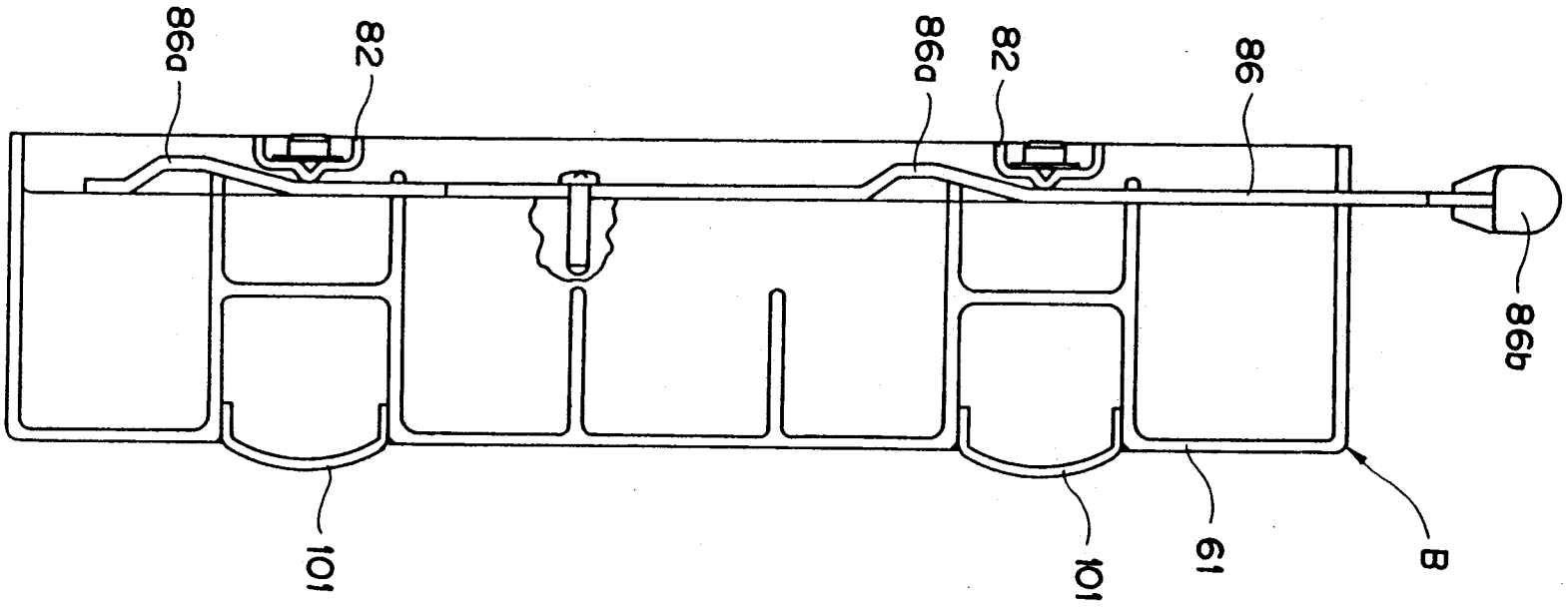
FIG. 15 plan view showing a thickness determining section of an automatic planing machine according to another embodiment of the invention.

FIG. 15 is a cross sectional view of a thickness determining reference section B used in an automatic planning machine according to another embodiment of the invention. Namely, instead of the pressing rollers 76 (see FIG. 12) for depressing the workpiece, a pair of pressing members 101 each having a projected surface on the side of the delivery path 8 (i.e. , to the right in FIG. 15) are formed in the support plate 78 (see FIG. 12). The pressing members 101 are provided not to be rotatable like the pressing rollers 76. During the cutting operation, the workpiece 2 is to be slid on and along the surfaces of the pressing members 101.

Figure 16:
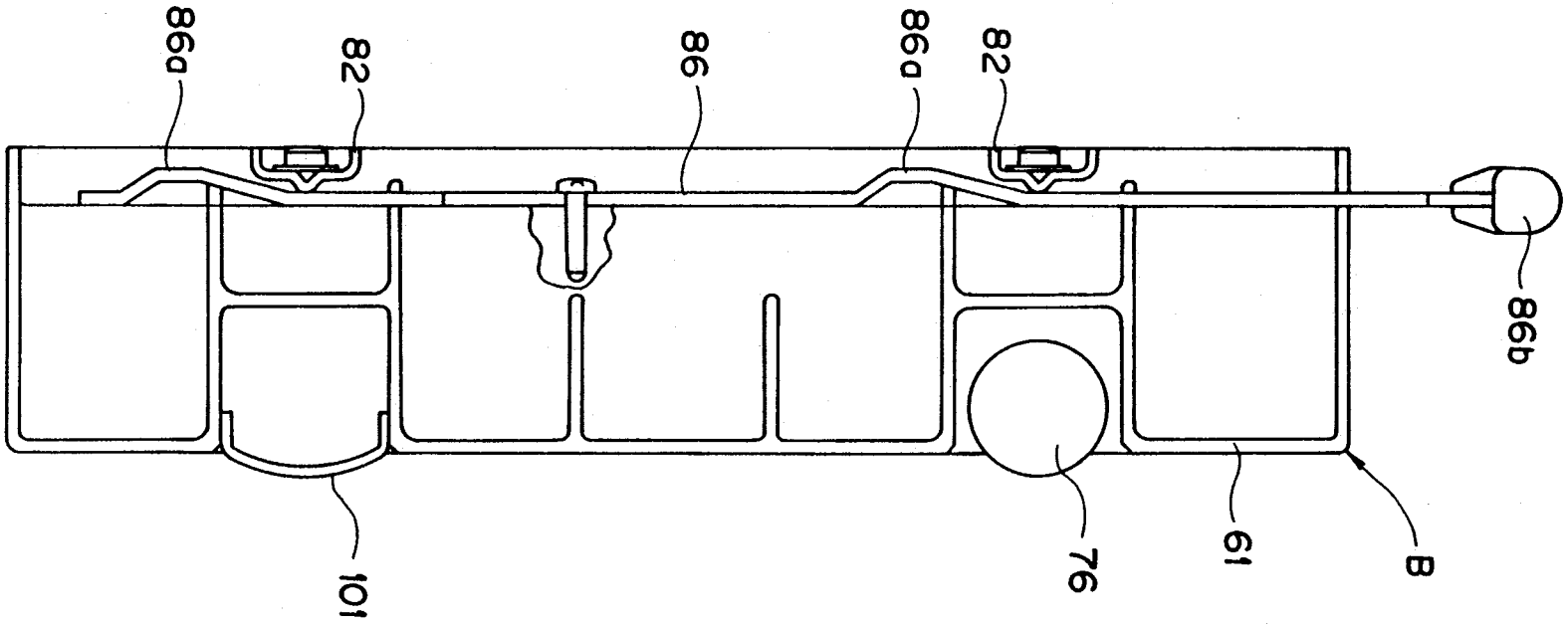
FIG. 16 is a plan view showing a thickness determining section of an automatic planing machine according to another embodiment of the invention.

Also, as shown in FIG. 16, one of the pressing members may be a pressing roller 76 and the other may be a pressing member 101.

Figure 17:
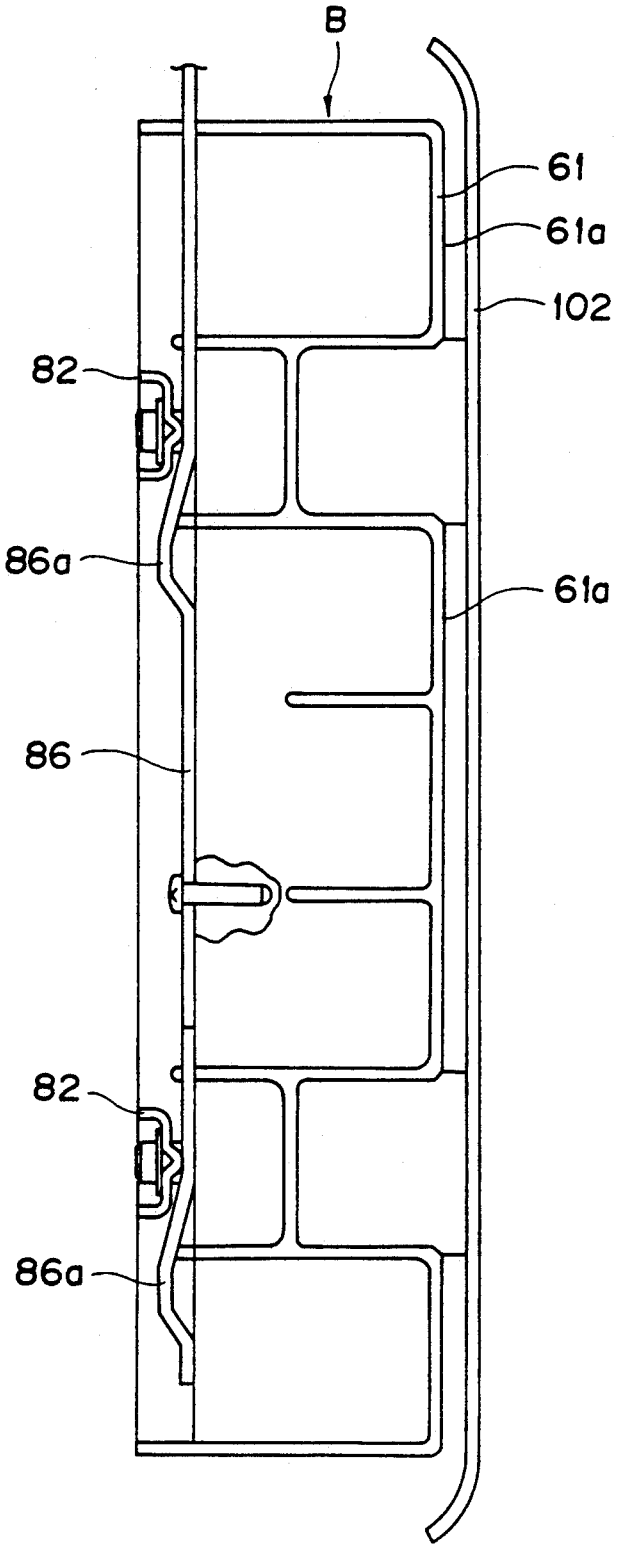
FIG. 17 is a plan view showing a thickness determining section of an automatic planing machine according to still another embodiment of the invention.

Furthermore, as shown in FIG. 17, instead the pressing rollers 76 and the pressing members 101, a plate member 102 which may cover the entire reference surface 61*a* of the thickness determining reference base 61 and which has an elasticity may be provided on the support plate 78 (FIG. 12).

Figure 18:
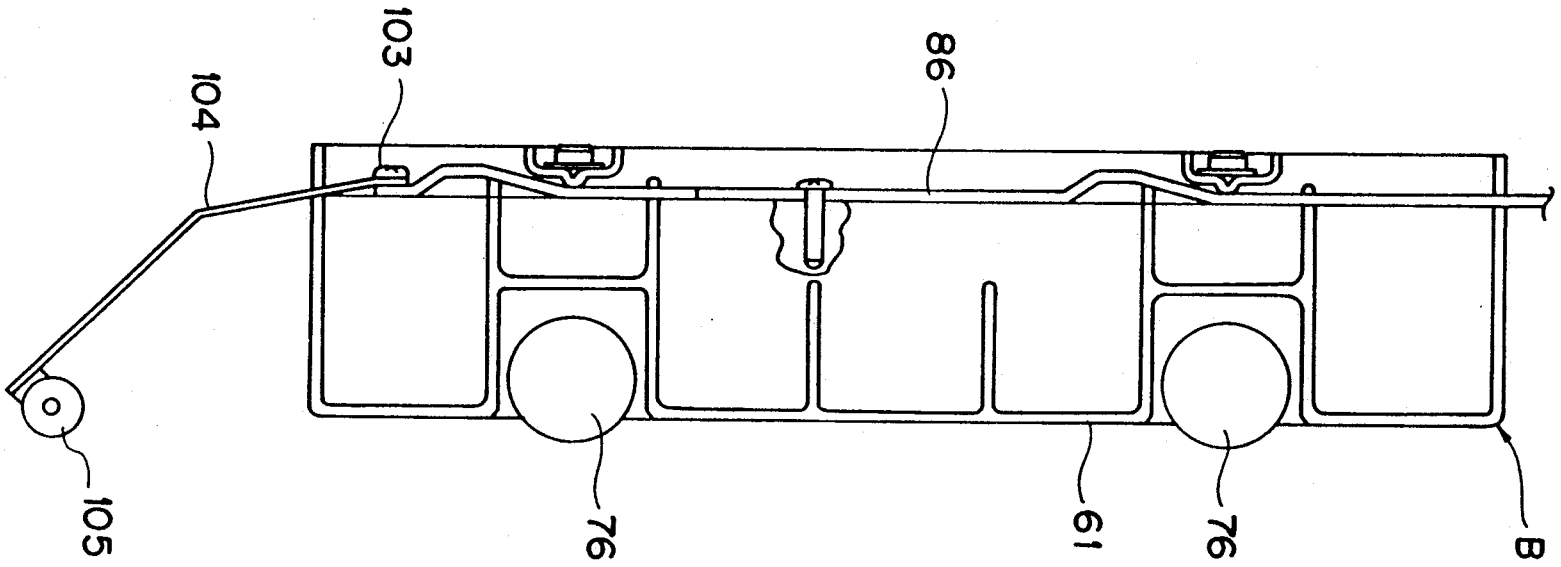
FIG. 18 is a plan view showing a thickness determining section of an automatic planing machine according to still another embodiment of the invention.

Also, as shown in FIG. 18, a leaf spring 104 is provided at one end of the operating plate 86 through a screw 103. A roller 105 is rotatably provided at the end of the leaf spring 104. The roller 105 is biased toward the feeding path 8, i.e., the right in FIG. 18 by the leaf spring 104. Thus, during the cutting operation (in particular, planing) , the workpiece 2 is depressed to the section A (see FIG. 1), i.e., to the right in FIG. 18 by the two pressing rollers 76 and the roller 105.

Figure 19:
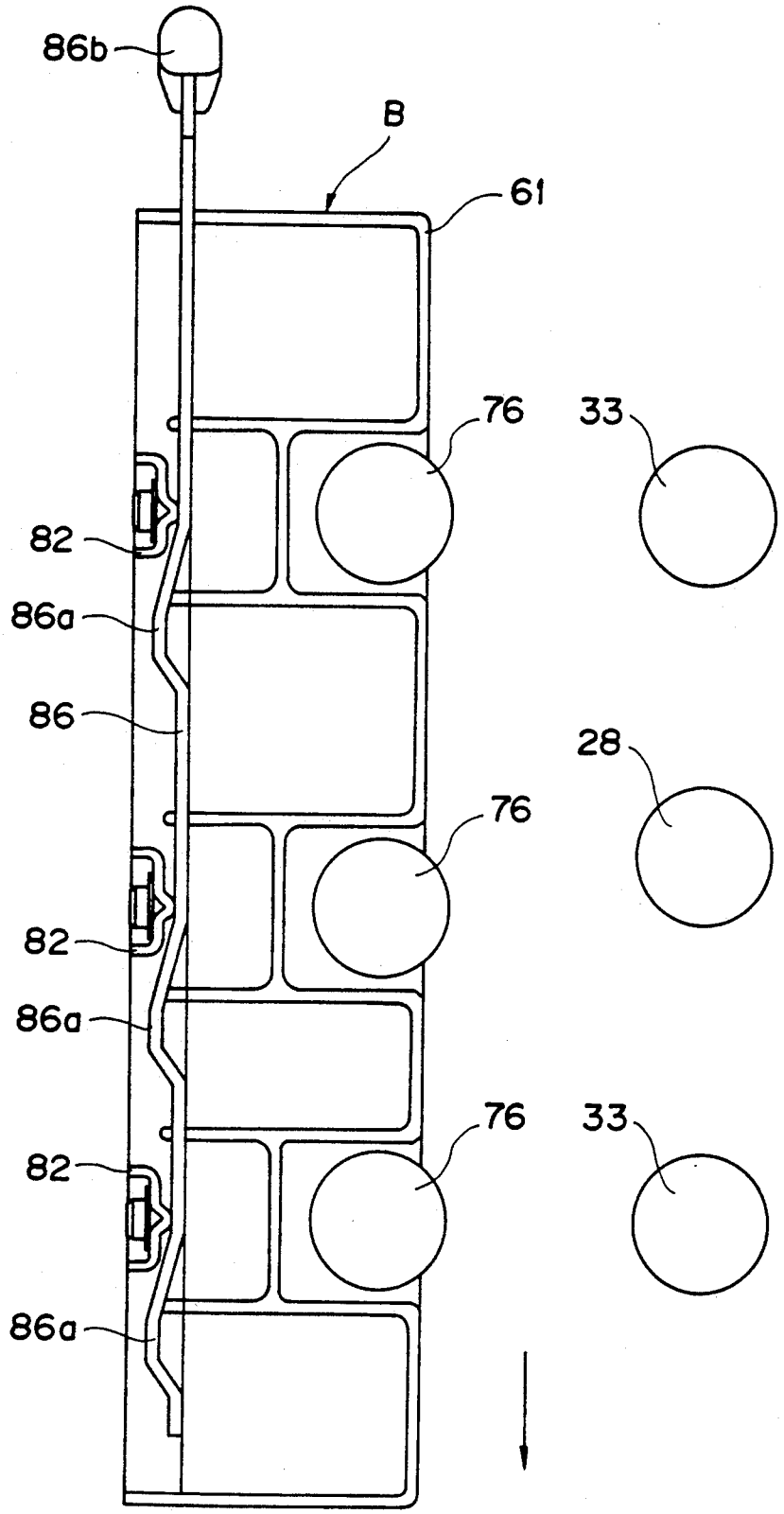
FIG. 19 is a plan view showing a thickness determining section of an automatic planing machine according to still another embodiment of the invention.

FIG. 19 shows an example where three pressing rollers 76 are provided instead of the pair of pressing rollers. In this case, two of them located on both ends are located to face the feed rollers 33 on the section A, and the middle pressing roller 76 is provided so as to offset to the downstream side of the feeding path (rear side FIG. 19) beyond the cutter block 28. Thus, it is possible to ensure the depression of the workpiece against the cutter block 28 to thereby prevent any lift of the workpiece.

Figure 20:
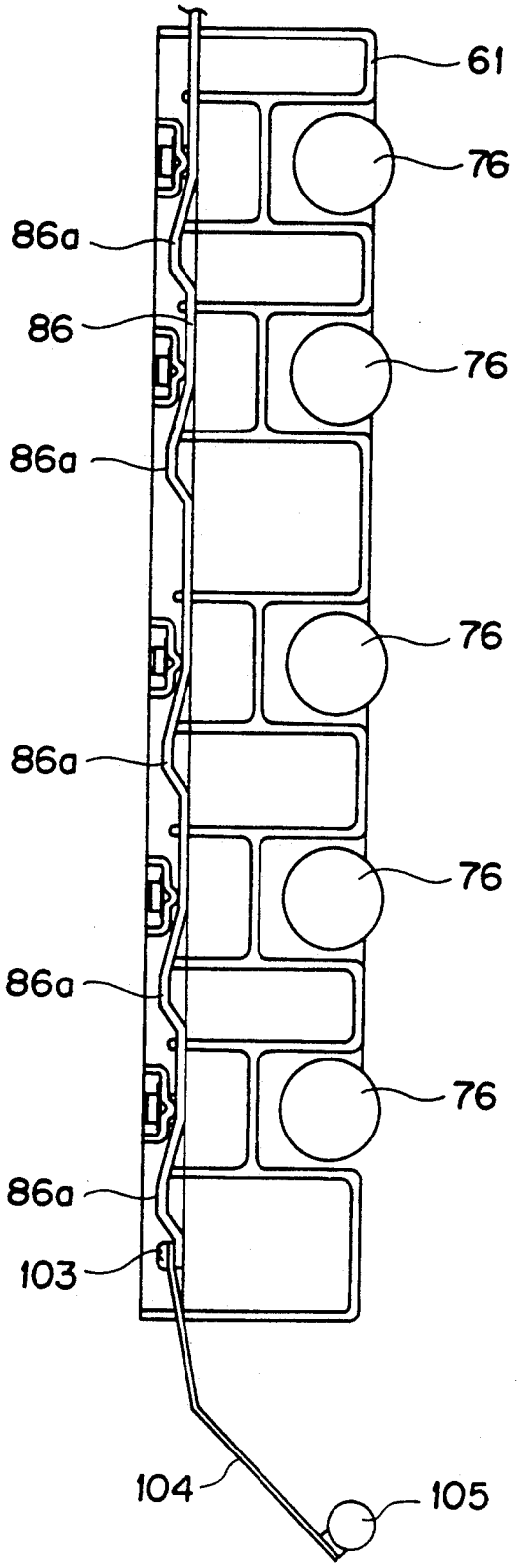
FIG. 20 is a plan view showing a thickness determining section of an automatic planing machine according to still another embodiment of the invention.

The number of the pressing rollers 76 is not limited to a specific number (two or three). As shown in FIG. 20, it is possible to use a number of pressing rollers 76. In this manner, the increase of the number of the pressing rollers 76 makes it possible to stabilize the feeding of the workpiece during the cutting operation, in particular, in planing.

Figure 21:
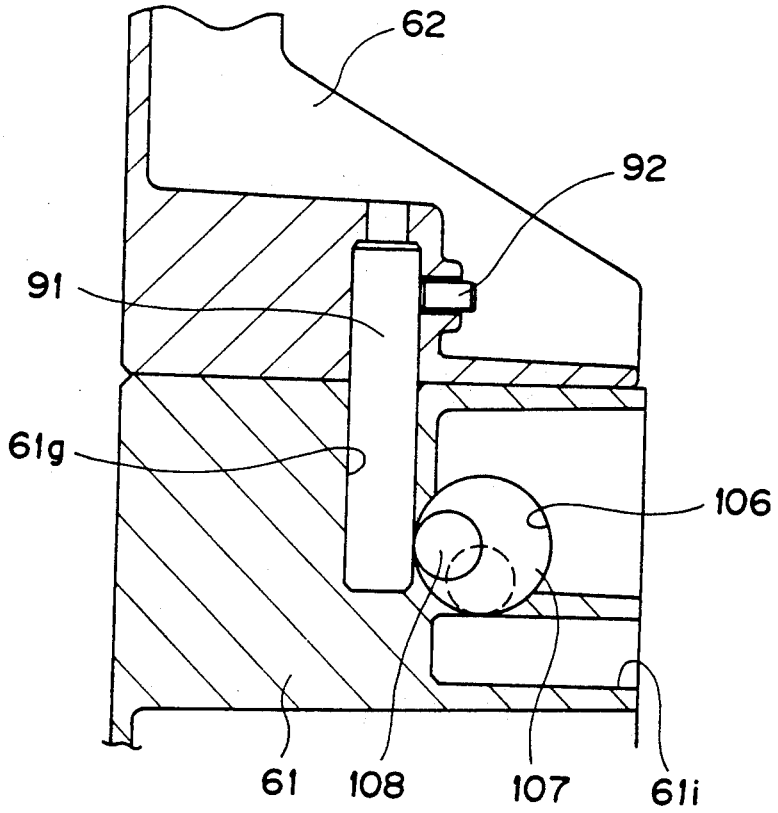
FIG. 21 is a schematic view showing a fastening mechanism for fastening and positioning the auxiliary reference base of the automatic planing machine according to another embodiment of the invention.

On the other hand, FIG. 21 is a cross sectional view showing an example of a structure for positioning and mounting the auxiliary reference base for an automatic planing machine according to the present invention. In this example, the same reference numerals are used to denote the same components or members as those in FIG. 13 and detailed explanation therefor has been omitted. In this example, a circular hole 106 is provided in a side wall of the thickness determining reference base 61, and a disc 107 is rotatably provided in the circular hole 106. An eccentric shaft 108 is eccentrically fixed to the disc 107. The eccentric shaft 108 is arranged so as to be contactable with the vertical position hole 61*g* or the horizontal position hole 61*i*. The eccentric shaft 108 is rotated and the pin 91 is depressed thereby, so that the auxiliary reference base 62 is fixed to the thickness determining reference base 61.

Figure 14:
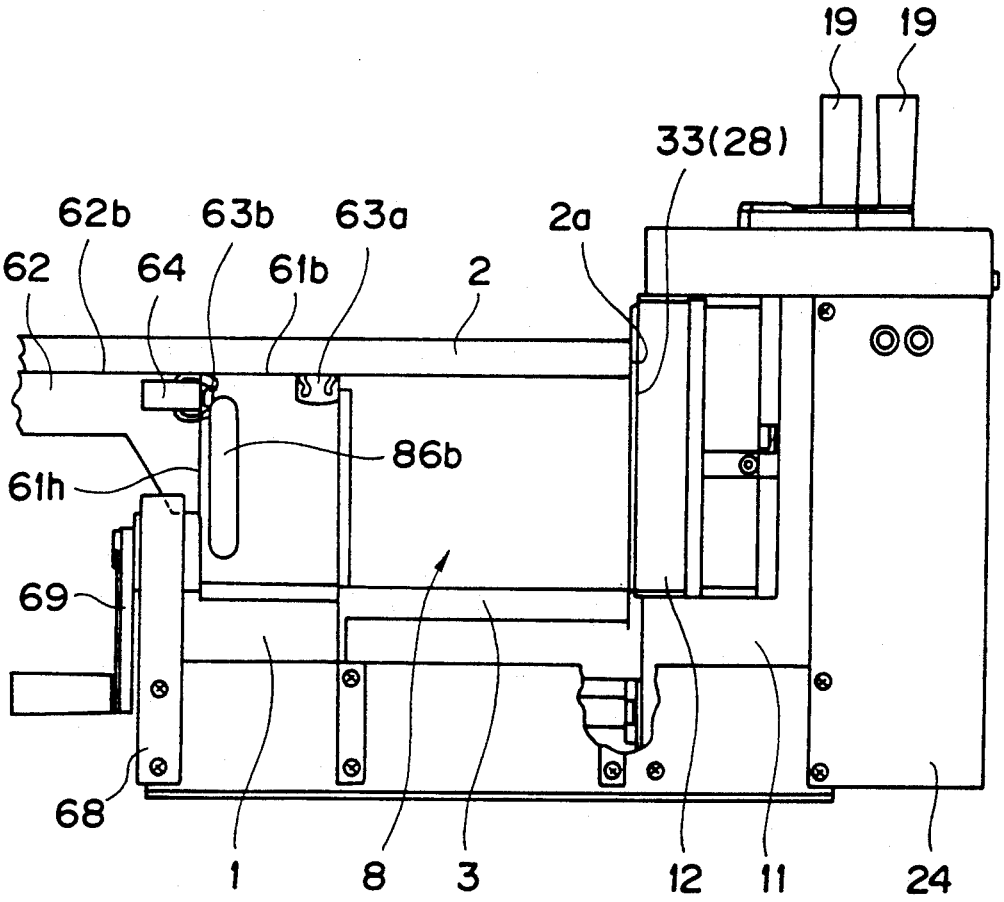
FIG. 14 is a frontal view showing the automatic planing machine according to the present invention in a different condition shown in FIG. 1 in which the workpiece is laid horizontally.
Figure 22:
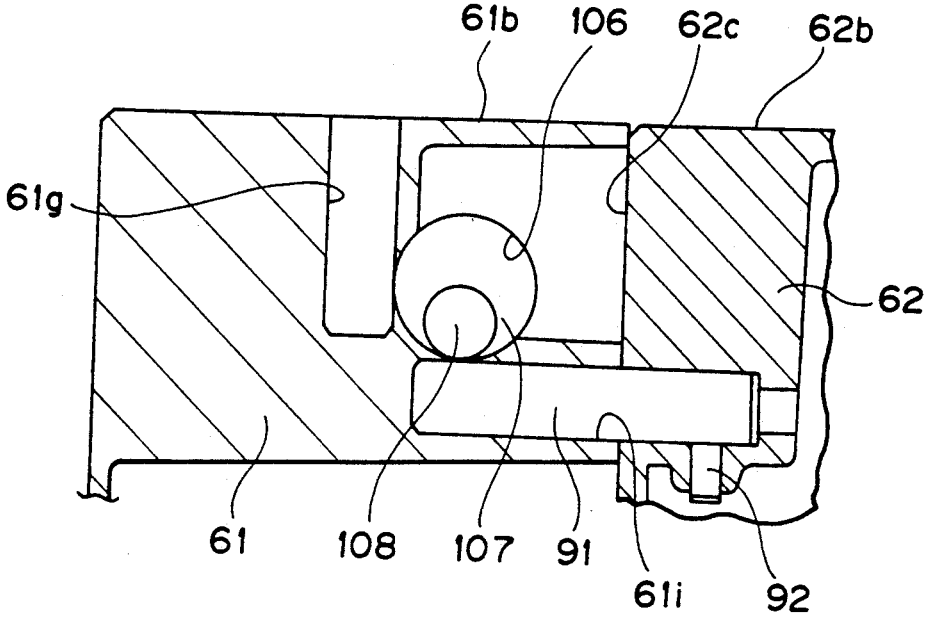
FIG. 22 is a schematic view showing the fastening mechanism in the horizontal position.
Figure 23:
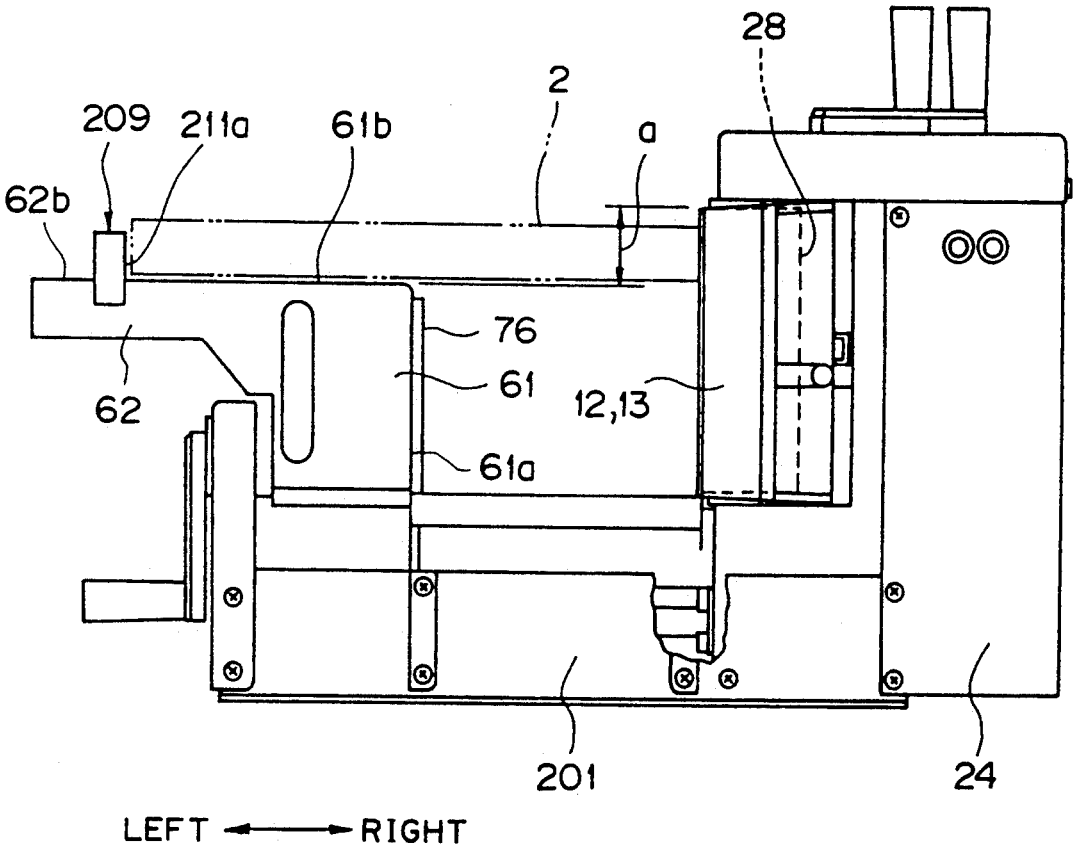
FIG. 23 is a frontal view showing an automatic planing machine provided with a workpiece guide device according to the present invention.
Figure 24:
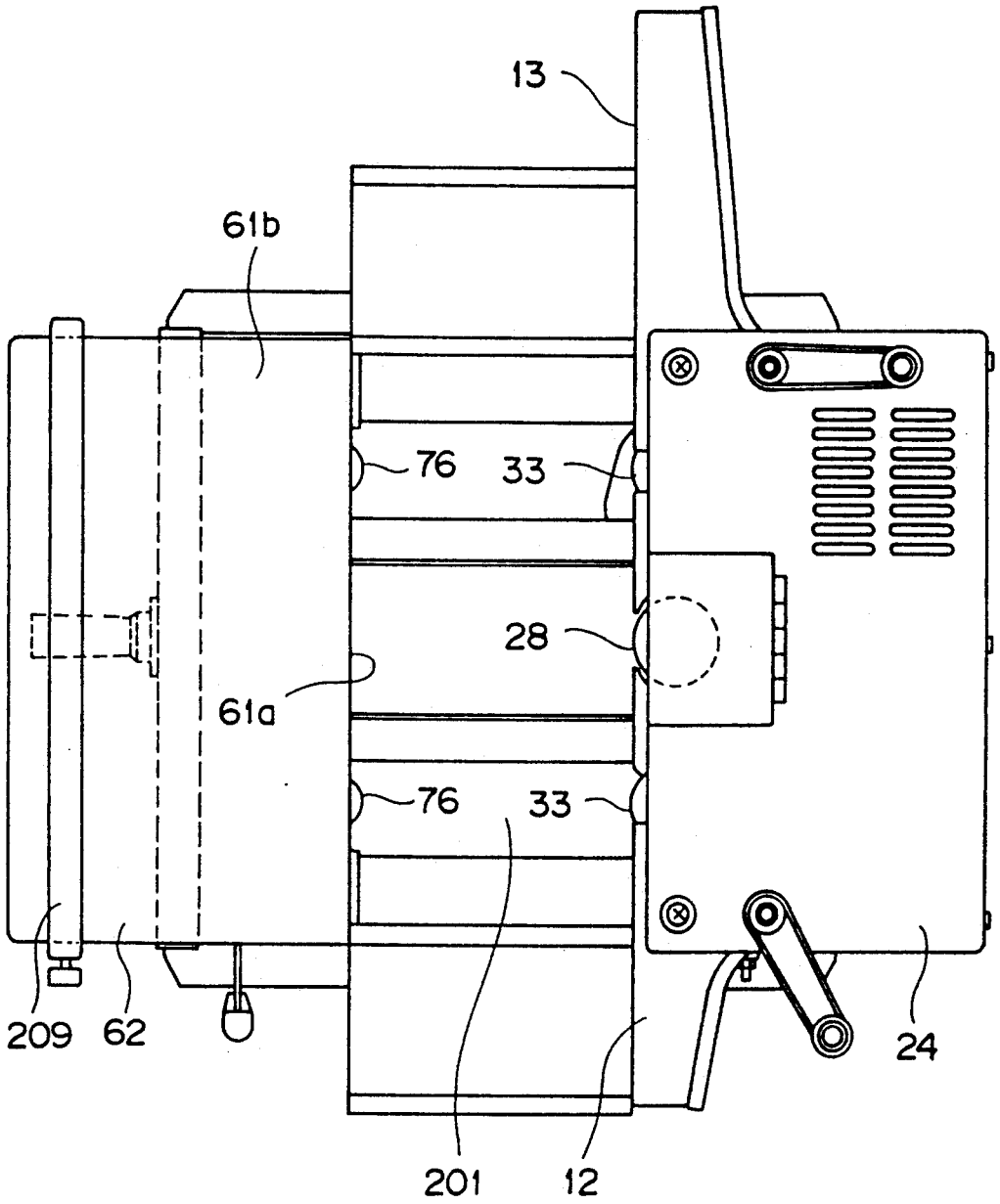
FIG. 24 is a plan view showing the planing machine shown in FIG. 23.

FIG. 22 is a cross sectional view showing a case where in the position shown in FIG. 14, the end face of the workpiece 2 is cut or planed. As shown in FIG. 22, the pin fixed to the auxiliary reference base 62 is inserted into the horizontal positioning hole 61*i* formed in the opposite surface 61*h* of the thickness determining reference base 61 so that the top surface 61*b* of the thickness determining reference base 61 and the reference surface 62*b* of the auxiliary reference base 62 are flush with each other. Then, the fastening shaft or disc 107 is rotated so that the eccentric shaft 108 is brought into contact with the pin 91, whereby the auxiliary reference base 62 is fixed to the thickness determining reference base 61. If this fastening and mounting structure shown in FIGS. 21 and 22 is used as described above, it is possible to dispense with the key and hook structure shown in FIGS. 1, 9 and 14.

As described above, according to the present invention, the rotary shaft of the cutter block which performs the cutting operation of the workpiece is set substantially in the vertical direction, and the upper side of the feeding path of the workpiece is opened. Accordingly, since the cutting operation is free from the adverse effect of the gravitational force of the workpiece, it is possible to effect the cutting operation of the workpiece having a cut surface longer than the longitudinal length of the cutter block with a high precision. In the case where the height of the cutter block is larger than that of the reference base and the top surface of the reference base is held horizontally to guide the workpiece, it is possible to effect the cutting of the end face of a wide workpiece. Furthermore, since the auxiliary reference base is detachably attached to the reference base, when the auxiliary reference base is mounted on the top surface of the reference base, it is possible to effect the feeding of the workpiece. Also, when the auxiliary reference base is mounted on a side wall of the reference base, it is possible to stabilize the feeding of the workpiece during the end face cutting of the wide workpiece. Thus, it is possible to enhance the machining precision, and to make compact the overall planing machine apparatus. Also, the automatic planing machine is versatile.

Still another embodiment of the invention will now be described with reference to FIGS. 23 to 26 in which the same reference numerals are used to denote the same components and members as those in the foregoing embodiments. In this embodiment, substantially the same arrangement as that of the foregoing embodiment is taken. An automatic planing machine shown in FIGS. 23 and 24 has a bottom frame 201 extending in the right and left directions, and a vertical frame or cover 24 extending in an upright manner from a right end of the bottom frame 201. A cutter block 28 is provided vertically at the left end of the vertical frame 24, and front and rear bases 12 and 13 having a pair of feed rollers 33, respectively, are arranged in front of and behind the cutter block 28. A vertical (thickness determing) reference base 61 having a vertical reference surface 61*a* is provided at the left end of the bottom frame 201 so as to face the cutter block laid vertically. The vertical reference base 61 is lower in height than the cutter block 28 and is provided at its top surface with a horizontal reference surface 61*b*. Feed rollers 76 are provided within the vertical reference base 61 so as to face the feed rollers 33. The reference base 61 has an auxiliary reference base 62 on its left side in order to enlarge an area of the horizontal reference surface 61*b*. The auxiliary base 62 may be formed integrally with the vertical reference base 61 or may be formed separatably from the reference base 61. The horizontal surface 616 of the base 61 extends perpendicular to a center axis of the cutter block 28 and is flush with the top surface 62*b* of the auxiliary base 62. The horizontal reference surface 61*b* and the vertical reference surface 61*a* are displaceable in the right and left directions by a feed screw (not shown).

Figure 25:
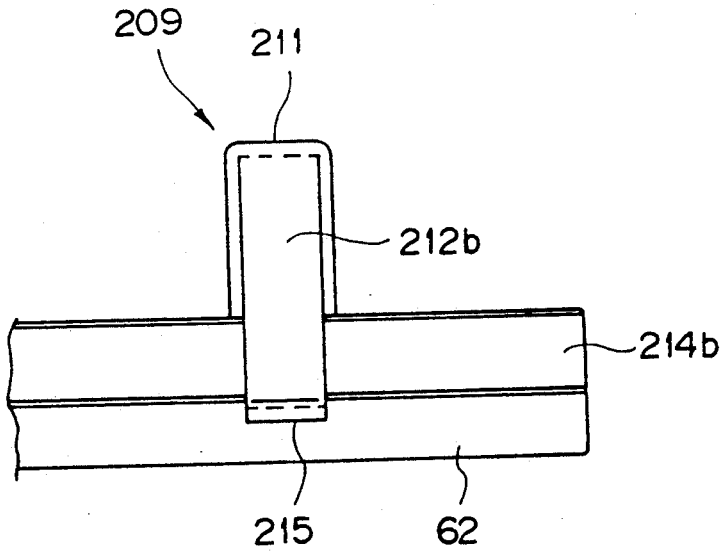
FIG. 25 is an enlarged view, as viewed from the rear side of the automatic planing machine, showing the left end of the auxiliary reference base and the guide scale shown in FIG. 23.
Figure 26:
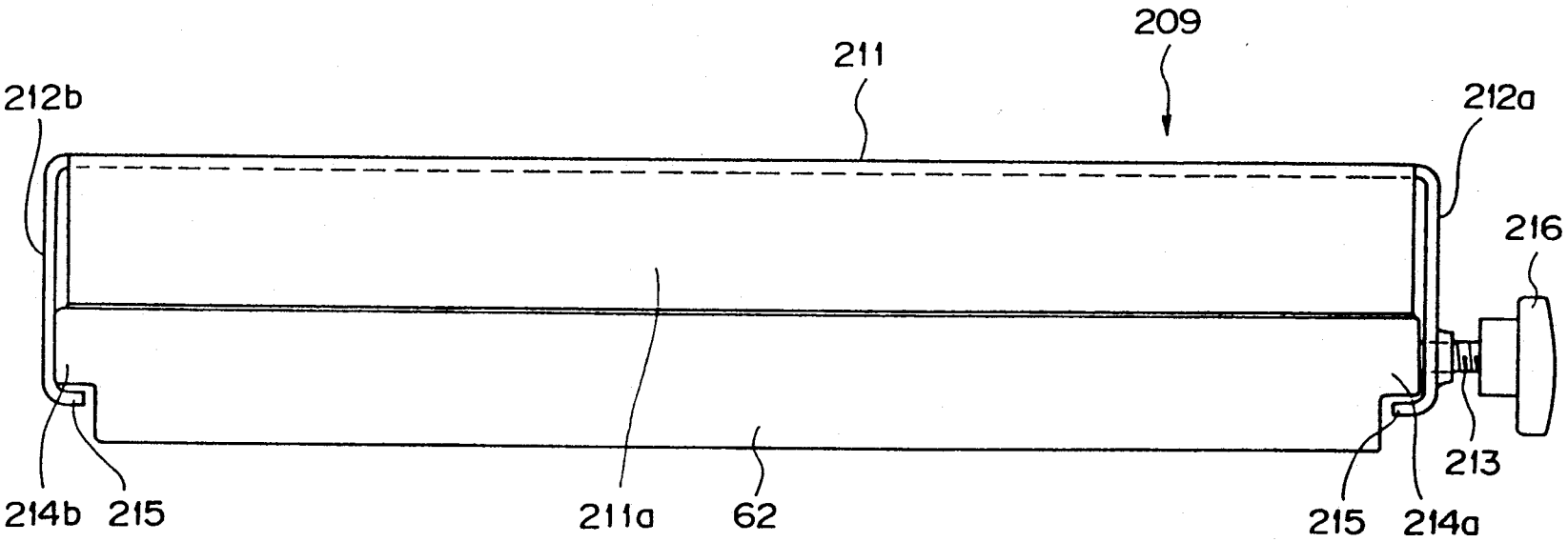
FIG. 26 is an enlarged view as viewed from the left side of the automatic planing machine, showing the guide scale shown in FIG. 23.

A scale 209 is mounted to be movable close to or away from the cutter block 28. As shown in FIGS. 25 and 26, the scale 209 has a body 211 extending in the front and rear directions on the auxiliary reference base 62, retainer members 212*a* and 212*b* provided at front and rear ends of the body 211, and a fastening screw 213 for fastening the scale body 211 to the auxiliary reference base 62. The scale body 211 has an upright wall 211*a* which is to be in contact with one edge of the workpiece 2. The retainer members 212*a* and 212*b* are each bent in the form of a hook toward the auxiliary reference base 62 and engaged with a pair of rails 214*a* and 214*b* formed at both ends of the auxiliary reference base 62. With such an arrangement, the pair of rails 214*a* and 214*b* are clamped from above and below by a lower portion of the upright wall 211*a* of the body 211 and the lower end portions 215 of the retainer members 212*a* and 212*b*. The stop screw 213 is brought into contact with the rail 214*a* through a screw hole formed in one of the retainer members 212*a*. A knob 216 is fixed to the outer end of the fastening screw 213. Thus, it is possible to fasten or loosen the fastening screw 213 to the scale 209 by rotating the knob 216.

The operation of the thus constructed workpiece guide device for the automatic planing machine will be explained. First of all, the positional adjustment of the scale 209 is effected in conformity with a width of the workpiece 2. To effect this, the knob 216 is rotated to loosen the fastening screw 213 to move the scale 209 on and along the auxiliary base 62. Then, the knob 216 is roated in the reverse direction to fix the scale 209 in place by the fastening screw 213.

Subsequently, the workpiece 2 is applied to the reference surfaces 61*b* and 62*b* of the reference base 61 and the auxiliary base 62 and also to surface of the upright wall 211*a* of the scale 209 and is fed from the rear side to the front side of the planning machine. Thus, the other end face of the workpiece 2 is cut by the cutter block 28 to effect the planing of the end face of the workpiece 2.

Since it is possible to feed the workpiece with its top surface up side down, it is possible to effect the end face cutting of the workpiece having a thickness which is approximately twice larger then a distance a (in FIG. 23) between the horizontal surface 61*b* of the reference base 61 and the upper end of the cutter block 28.

Figure 27:
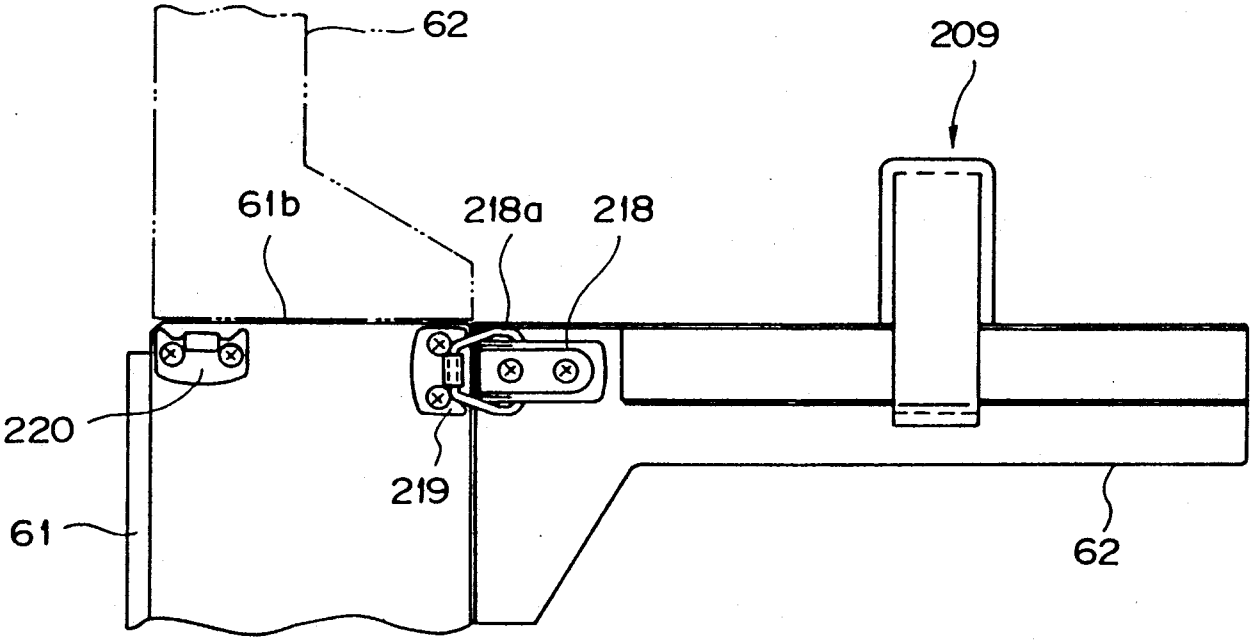
FIG. 27 is an enlarged view as viewed in the same direction as in FIG. 25, showing an auxiliary reference base in accordance with another embodiment of the invention.

Incidentally, the separatable auxiliary reference base may be detachably fastened to the vertical reference base 61 as a discrete member by a click buckle key assembly as shown in FIG. 27. In the structure shown in FIG. 27, a click buckle key body 218 is mounted on the auxiliary base 62, whereas an associated hook portion 219 is fixed to the vertical base 61. It is possible to attach the auxiliary reference base 62 on the rear side of the vertical reference base 61 by disengaging a ring 218*a* of the click buckle key body 218 from the hook portion 219 and engaging the ring 218*a* with a hook portion 220. Thus, the auxiliary base 62 is positioned vertically and coupled to the vertical base 61 to increase the height of the base for the thickness determining planing of the workpiece 2.

The hook portion 220 may be provided on a side wall of the vertical reference base 61 by changing the directionability of the hook portion 219.

What is claimed is:

1. An automatic planning machine for cutting a surface of a workpiece, comprising:

a base portion having a feeding path on which the workpiece is to be laid to feed the workpiece;

a rotatable cutter block disposed on one side of said feeding path of the base to face the feeding path, said rotatable cutter having a rotary shaft substantially extended in a vertical direction with respect to the feeding path;

a reference base having a guide surface disposed on the other side of said feeding path to face said rotatable cutter block, and extending along the feeding path, said guide surface being substantially vertical to the feeding path; and a feeding device for moving the workpiece laid on said feeding path in a feeding direction along the feeding path;

wherein an upper side of said feeding path between said reference base and said cutter block is opened.

2. The automatic planing machine according to claim 1, wherein a height of said reference base is lower than that of the cutter block, and a top surface of said reference base is kept horizontally.

3. The automatic planing machine according to claim 1, further comprising an auxiliary reference base which is detachably mountable on a top surface of said reference base.

4. The automatic planing machine according to claim 3, wherein a scale is slidably provided on the auxiliary reference base.

5. The automatic planing machine according to claim 2, further comprising an auxiliary reference base which is detachably mountable on said top surface of said reference base.

6. The automatic planing according to claim 5, wherein a scale is slidably provided on the auxiliary reference base.

7. The automatic planing machine according to claim 1, further comprising a planing reference base disposed on a side of said cutter block, wherein said feeding device includes rotatable roller means, disposed on the reference base, each of which has a rotary axis substantially in a vertical direction, and spring members for pressing the workpiece through the roller means, and a pressing device disposed in said reference base facing said planing reference base, for generating selectively a pressure which is larger than a pressure of said spring members of said roller means and a pressure which is smaller than the pressure of said spring members of said roller means to press the workpiece.

8. The automatic planing machine according to claim 7, wherein said pressing device includes at least two rotatable rollers each having an axis substantially in the vertical direction.

9. The automatic planing machine according to claim 7, wherein said pressing device includes a plurality of pressing members.

10. The automatic planing machine according to claim 7, wherein said pressing device includes a rotatable roller and a pressing member.

11. The automatic planing machine according to claim 7, wherein said pressing device includes an elastic member which covers a reference surface of said reference base.

12. The automatic planing machine according to claim 7, wherein said pressing device includes a leaf spring for pressing the pressing device to the workpiece.

13. The automatic planing machine according to claim 3, further comprising positioning and fastening means for positioning and fastening said auxiliary reference base to said top surface of said reference base, wherein said positioning and fastening means includes a pin fixed to said auxiliary reference base, a hole formed in said reference base for receiving said pin, and rotatable shaft having an eccentric shaft to be brought into firm contact with said pin inserted into said hole.

14. The automatic planing machine according to claim 3, further comprising positioning and fastening means for positioning and fastening said auxiliary reference base to said top surface of said reference base, wherein said positioning and fastening means includes a click buckle key assembly.

15. The automatic planing machine according to claim 3, further comprising positioning and fastening means for selectively positioning and fastening said auxially reference base to a top surface and a side wall of said reference base wherein said positioning fastening means includes a pin formed in a surface, to contact said reference base, of said auxiliary reference base; a vertical position hole, formed in the top surface of said reference base, into which said pin may be inserted; a horizontal position hole, formed in the side wall of said reference base, into which said pin may be inserted; a circular hole in communication with said vertical position hole and said horizontal position hole; a fastening shaft which is inserted into said circular hole; and an eccentric shaft eccentrically fixed to said fastening shaft.

16. The automatic planing machine according to claim 1, further comprising a roller case, wherein said feeding device comprises a feed roller, said roller case rotatably supporting said feed roller and cutter block in a vertical orientation spaced laterally from said reference base to provide clearance for said work piece therebetween.

17. The automatic planing machine according to claim 1, further comprising an auxiliary reference base which is detachably mounted on an outer side wall of said reference base.

18. The automatic planing machine according to claim 2, further comprising an auxiliary reference base which is detachably mounted on an outer side wall of said reference base.

19. The automatic planing machine according to claim 18, further comprising positioning and fastening means for positioning and fastening said auxiliary reference base to said outer side wall of said reference base, wherein said positioning and fastening means includes a pin fixed to said auxiliary reference base, a hole formed in said reference base for receiving said pin, and a rotatable shaft having an eccentric shaft to be brought into firm contact with said pin inserted into said hole.

20. The automatic planing machine according to claim 18, further comprising positioning and fastening means for positioning and fastening said auxiliary reference base to said outer side wall of said reference base, wherein said positioning and fastening means includes a click buckle key assembly.

* * * * *

UNITED STATES PATENT AND TRADEMARK OFFICE

CERTIFICATE OF CORRECTION

PATENT NO. : 5,284,192

DATED : February 8, 1994

INVENTOR(S) : Sato et al.

It is certified that error appears in the above-identified patent and that said Letters Patent is hereby corrected as shown below:

Column 14, line 14, claim 1, replace "planning" with --planing--;

Column 14, line 16, claim 1, delete "portion";

Column 16, line 24, claim 19, replace "18" with --17--;

Column 16, line 33, claim 20, replace "18" with --17--.

Signed and Sealed this

Sixth Day of September, 1994

Bruce Lehman

*Attest:*

BRUCE LEHMAN

*Attesting Officer*

*Commissioner of Patents and Trademarks*